US007988373B2

(12) United States Patent
Vandermeulen

(10) Patent No.: US 7,988,373 B2
(45) Date of Patent: Aug. 2, 2011

(54) TAPE PRINTER, TAPE PRINTING SYSTEM, INK RIBBON CASSETTE FOR A TAPE PRINTER, METHOD OF LOADING A TAPE CASSETTE AND AN INK RIBBON CASSETTE INTO A TAPE PRINTER, AND TAPE CASSETTE FOR A TAPE PRINTER

(75) Inventor: Kris Vandermeulen, Bornem (BE)

(73) Assignee: DYMO, Sint-Niklaas (BE)

( * ) Notice: Subject to any disclaimer, the term of this patent is extended or adjusted under 35 U.S.C. 154(b) by 224 days.

(21) Appl. No.: 10/593,761

(22) PCT Filed: Mar. 23, 2005

(86) PCT No.: PCT/IB2005/000919

§ 371 (c)(1),
(2), (4) Date: Nov. 6, 2006

(87) PCT Pub. No.: WO2005/092629

PCT Pub. Date: Oct. 6, 2005

(65) Prior Publication Data

US 2007/0172293 A1 Jul. 26, 2007

(30) Foreign Application Priority Data

Mar. 24, 2004 (GB) ..... 0406642.9

(51) Int. Cl.

| | |
|---|---|
| ***B41J 35/28*** | (2006.01) |
| ***B41J 32/00*** | (2006.01) |
| ***B41J 33/02*** | (2006.01) |
| ***B41J 15/00*** | (2006.01) |

(52) U.S. Cl. ..... 400/613; 400/207; 400/208; 347/214

(58) Field of Classification Search ..... 400/207, 400/615.2, 208, 613; 347/214
See application file for complete search history.

(56) References Cited

U.S. PATENT DOCUMENTS

| | | | | | |
|---|---|---|---|---|---|
| 5,155,663 | A | * | 10/1992 | Harase | 361/679.31 |
| 5,435,657 | A | | 7/1995 | Pearce et al. | 400/208 |
| 5,645,360 | A | * | 7/1997 | Iwane et al. | 400/613 |
| 6,074,113 | A | * | 6/2000 | Cockerill et al. | 400/621 |
| 6,152,623 | A | * | 11/2000 | Palmer et al. | 400/208 |

(Continued)

FOREIGN PATENT DOCUMENTS

GB 2 161 754 A 1/1986

(Continued)

OTHER PUBLICATIONS

International Search Report for PCT/IB2005/000919.
Written Opinion of the International Searching Authority for PCT/IB2005/000919.

*Primary Examiner* — Leslie J Evanisko
*Assistant Examiner* — Marissa L Ferguson-Samreth
(74) *Attorney, Agent, or Firm* — Marshall, Gerstein & Borun LLP

(57) ABSTRACT

A tape printer for use with a tape cassette and an ink ribbon cassette, the printer comprising a housing and a printhead having a line of printing elements thereon, wherein said printer comprises at least one cassette receiving portion in said housing for receiving the tape cassette and the ink ribbon cassette, such that the cassettes are receivable in a direction which is substantially perpendicular to the line of printing elements on the printhead when the printhead is in a printing position.

2 Claims, 20 Drawing Sheets

U.S. PATENT DOCUMENTS

| | | | | |
|---|---|---|---|---|
| 6,406,202 | B1 * | 6/2002 | Unno et al. | 400/613 |
| 6,422,771 | B1 * | 7/2002 | Chvojcsek et al. | 400/235 |
| 6,520,696 | B2 * | 2/2003 | Huss et al. | 400/208 |
| 6,522,349 | B1 | 2/2003 | Lee | 347/214 |
| 6,923,660 | B2 * | 8/2005 | Takeuchi | 439/76.2 |
| 2002/0031388 | A1 | 3/2002 | Palmer et al. | 400/615.2 |

FOREIGN PATENT DOCUMENTS

| | | |
|---|---|---|
| WO | WO 99/44834 | 9/1999 |
| WO | WO-2004/059241 A2 | 7/2004 |

* cited by examiner

TAPE PRINTER, TAPE PRINTING SYSTEM, INK RIBBON CASSETTE FOR A TAPE PRINTER, METHOD OF LOADING A TAPE CASSETTE AND AN INK RIBBON CASSETTE INTO A TAPE PRINTER, AND TAPE CASSETTE FOR A TAPE PRINTER

REFERENCE RELATED TO APPLICATIONS

This application is a U.S. National Phase of international application no. PCT/IB2005/000919, filed Mar. 23, 2005, and claims priority to GB 0406642.9, filed Mar. 24, 2004.

FIELD OF INVENTION

The invention relates to a tape printer. Particularly but not exclusively, the invention relates to a handheld tape printer for use with a cassette housing a print receiving medium and a separate cassette housing a print forming medium, such as an image transfer tape.

BACKGROUND OF THE INVENTION

Known tape printers may be divided into two types: tape printers for use with a cassette which houses both a print receiving medium (hereinafter referred to as a tape which may be a continuous tape or may comprise a web carrying die cut labels) and a print forming medium (hereinafter referred to as an ink ribbon); and tape printers which are arranged for use with a cassette housing the tape and a separate cassette housing the ink ribbon. The advantage of the latter arrangement is that the ink ribbon cassette may be replaced with another cassette containing ink ribbon of either the same or a different type without replacing the tape cassette. This is advantageous in, for example, multicolored printing in which the ink ribbon cassette may be replaced with another cassette containing ink ribbon of a different color. Alternatively, the tape cassette may be replaced without replacing the ink ribbon cassette. This feature is advantageous if a different type of tape is required, such as a tape of a different width or a tape comprising a different material. Furthermore, a single ink ribbon cassette may be used for a plurality of tape cassettes with the ink ribbon in the ink ribbon cassette being longer than the tape in the tape cassette.

In this specification, systems which use a cassette containing both the tape and ink ribbon are referred to as D1-type systems and systems which use separate tape and ink ribbon cassettes are referred to as D2-type systems.

The most common arrangement for both D1 and D2 type systems comprises a tape printer having a cassette receiving portion in an upper surface thereof. The cassette receiving portion houses a printhead and a platen.

In known D1-type systems the cassette housing the tape and ink ribbon is inserted into the receiving portion from a top side in a direction which is parallel to an axis of rotation of the platen and also parallel to a line of print elements on the printhead such that when the cassette is received by the cassette receiving portion, the tape and the ink ribbon pass in overlap between the printhead and platen with the ink ribbon on the same side of the tape as the printhead. On receiving the cassette in the cassette receiving portion, the printhead and/or the platen roller are moveable so as to pinch the ink ribbon and tape therebetween for printing.

In known D2-type arrangements the printer comprises a cassette receiving portion for receiving the tape cassette and the ink ribbon cassette. The cassette receiving portion houses a platen and a printhead and the tape cassette and the ink ribbon cassette are inserted from a top side in a direction parallel to an axis rotation of the platen and also parallel to a line of printing elements on the printhead. When received in the cassette receiving portion, the tape and the ink ribbon pass in overlap between the printhead and the platen with the printhead and/or the platen being moveable so as to pinch the tape and ink ribbon therebetween for printing.

A disadvantage of this type of vertical loading arrangement is that the tape and/or ink ribbon may catch on elements of the printer such as the printhead and/or platen thus damaging the tape and/or ink ribbon. Furthermore, the cassettes used in such arrangements have portions of the tape/ink ribbon extending outside the housing of the cassette. Accordingly, the tape and/or ink ribbon may be damaged during storage as well as during use.

A D1-type arrangement which seeks to solve the above identified problem is disclosed in U.S. Pat. No. 5,435,657. This patent discloses a printer for use with a cartridge housing an ink ribbon and tape. A platen is provided in the cassette which co-operates with the tape and ink ribbon, the tape being disposed on a side closest to the platen relative to the ink ribbon. The printer has an opening on a side thereof for receiving the cassette which may be laterally inserted into the printer. When laterally inserted into the printer, the platen of the cassette operates with a printhead in the printer and a gear on the platen co-operates with a gear in the printer for advancing the tape and ink ribbon.

WO 99/44834 discloses a D2-type printer in which an ink ribbon cassette is laterally insertable in a side thereof. The tape is supplied as a spool which is insertable in a spool receiving portion from a top side of the printer. The printer houses a printhead and a platen for co-operation with the tape and ink ribbon which pass therebetween. In the arrangement disclosed in WO 99/44834 the platen and printhead are arranged such that the axis of rotation of the platen and a line of print elements on the printhead are parallel to the direction of insertion of the ink ribbon cassette. Accordingly, the above described problem of the ink ribbon catching the platen and/or the printhead remains in this arrangement. Furthermore, as the tape is not housed in a cassette it may be damaged during storage and use.

SUMMARY OF THE INVENTION

An aim of the embodiments described hereinafter is to solve the problems outlined above.

According to the invention there is provided a tape printer for use with a tape cassette and an ink ribbon cassette, said printer comprising a housing and a printhead having a line of printing elements thereon, wherein said printer comprises at least one cassette receiving portion in said housing for receiving the tape cassette and the ink ribbon cassette, such that the cassettes are receivable in a direction which is substantially perpendicular to the line of printing elements on the printhead when the printhead is in a printing position.

According to another aspect of the invention there is provided a tape printing system comprising a tape printer as defined above in combination with a tape cassette housing a supply of tape and an ink ribbon cassette housing a supply of ink ribbon.

According to another aspect of the invention there is provided an ink ribbon cassette for a tape printer, said cassette comprising a body having an ink ribbon supply portion housing an ink ribbon supply spool, an ink ribbon take-up portion housing an ink ribbon take up spool, and a member connecting said two portions, wherein an opening is provided in the body between the ink ribbon supply portion and the ink ribbon take up portion which extends over the entire width of the cassette body from a rear side to a front side in a direction perpendicular to axes of rotation of said spools, with ink ribbon passing from said ink ribbon supply portion to said ink ribbon take-up portion across said opening, said ink ribbon cassette further comprising a gear coupled to said ink-ribbon take-up spool at an upper or a lower portion thereof for coupling with a drive gear in a tape printer.

According to another aspect of the invention there is provided a method of loading a tape cassette and an ink ribbon cassette into a tape printer, said tape printer comprising a printhead having a line of printing elements thereon, said method comprising the step of inserting said tape cassette and said ink ribbon cassette into said tape printer in a direction which is substantially perpendicular to the line of printing elements on the printhead when the printhead is in a printing position.

Embodiments of the invention solve the above identified problems by providing a tape printer for use with a tape cassette and an ink ribbon cassette, in which the tape cassette and ink ribbon cassette are laterally insertable into the printer in a direction which is perpendicular to an axis of rotation of a platen and a line of print elements on a printhead within the printer. Accordingly, embodiments provide a D2-type system in which the tape cassette and ink ribbon cassette are loadable into the printer without the possibility of the tape and ink ribbon catching on elements of the printer such as the printhead and/or platen. Embodiments of the invention are user friendly and allow easy loading and unloading of cassettes into a tape printer. Furthermore, embodiments of the invention have the advantage over D1-type arrangements in that the tape cassette or the ink ribbon cassette can be replaced individually according to the requirements of a user.

According to another aspect of the invention there is provided a tape cassette for a tape printer, the tape cassette comprising a body having a base, a top, and sides extending from the base to the top, the body housing a roll of print receiving medium having an axis of rotation extending in a first direction, the body having a guide member on each of two opposing sides extending along said sides in a second direction perpendicular to the first direction for guiding the tape cassette into a tape printer in the second direction.

The two elongate guide members aid in both guiding the tape cassette into the tape printer and also aligning the tape cassette with a print head of the tape printer. The guide members also prevent movement of the cassette when inserted into the tape printer for better quality printing. The provision of an elongate guide member on opposing sides prevents rotational movement of the cassette.

Preferably, the tape cassette further comprises a supply spool extending in a first direction, the roll of print receiving medium being mounted on the supply spool. The tape cassette may also comprise a platen extending in the first direction and mounted in an opening of the body for cooperation with a print head of a tape printer in use.

Advantageously, the guide members should be adapted to prevent movement of the cassette in both vertical and horizontal directions when inserted into the tape printer. One such arrangement is provided by guide members comprising a first elongate member disposed in a plane perpendicular to the side walls of the cassette and a second elongate member disposed in a plane parallel to the side walls so as to prevent movement in both vertical and horizontal directions when the cassette is inserted in a printer. The guide members thus have a substantially T-shaped cross-section. With such an arrangement the cassette is very precisely positioned in the cassette-receiving bay relative to the print head for high quality printing.

BRIEF DESCRIPTION OF THE DRAWINGS

For a better understanding of the invention and to show how the same may be carried into effect, reference will now be made by way of example to the accompanying drawings in which.

Figure 1:
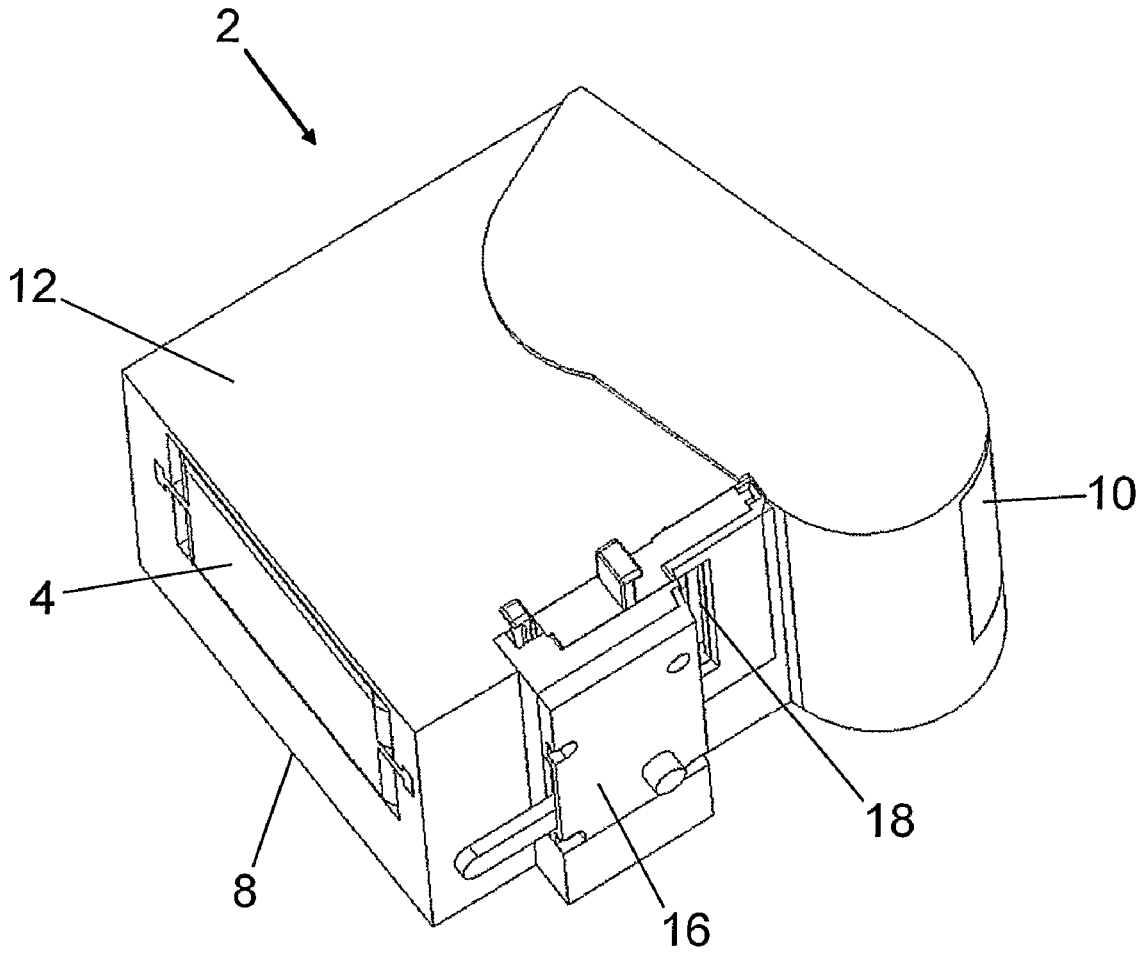
FIG. 1 is a schematic diagram of a D2-type printing system according to a first embodiment of the invention.

In the drawings, like parts are labelled with the same reference numeral. Furthermore, it is to be noted that the drawings are only schematic. In particular, the drawings show the cassette receiving part of printers according to embodiments of the invention. For clarity, other parts of the printer such as a keyboard and a display have not been illustrated. It is intended that the cassette receiving parts illustrated may be incorporated into a hand held printer or into a PC printer. For example, in one embodiment, the portion of the printer comprising the keyboard and display extends from a side of the cassette receiving part opposite the cutter mechanism in the illustrated embodiments.

DETAILED DESCRIPTION OF THE EMBODIMENTS OF THE INVENTION

Figure 2:
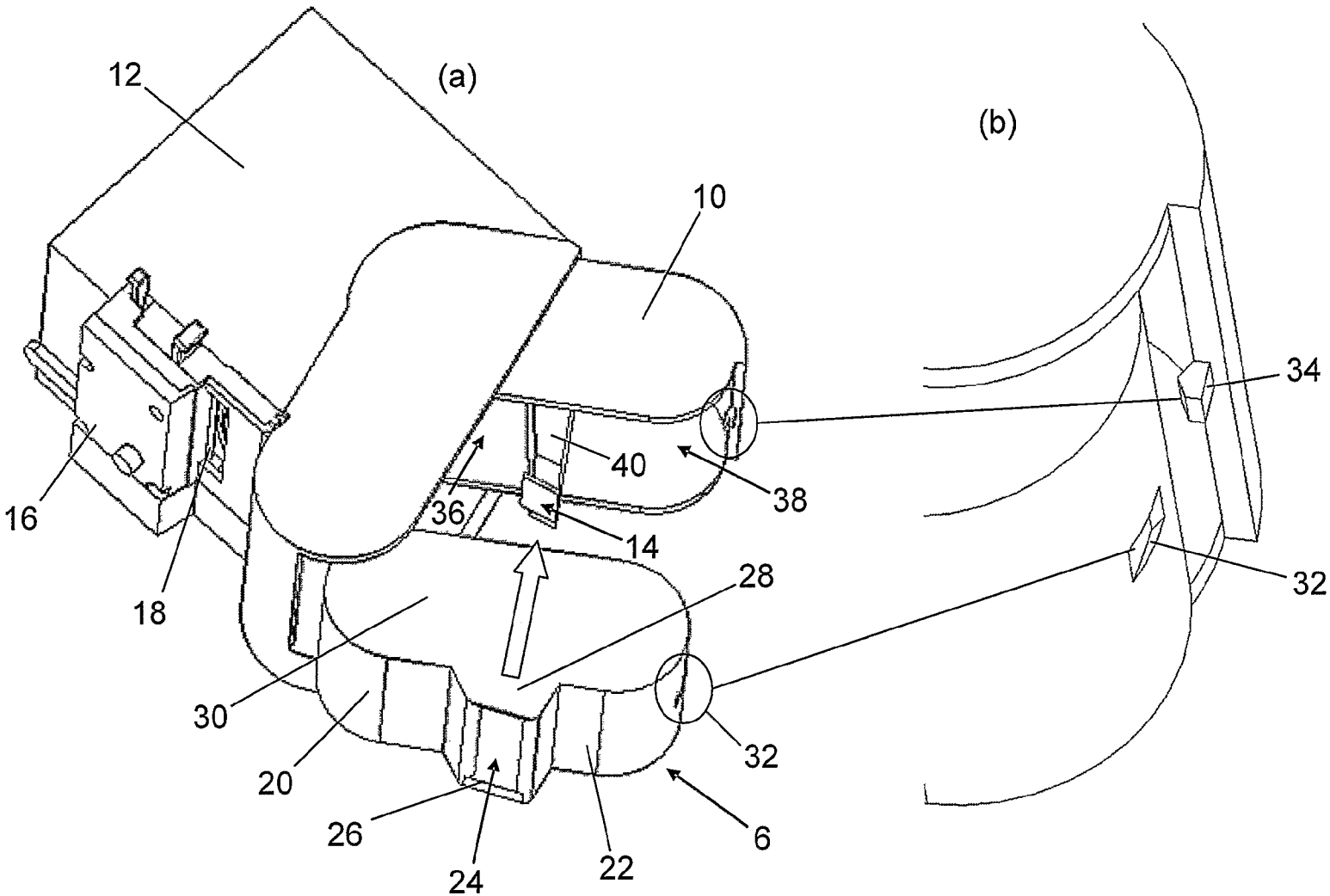
FIG. 2*a* is a schematic diagram illustrating loading of an ink ribbon cassette in the embodiment shown in FIG. 1.
FIG. 2*b* is an enlarged view of a locking mechanism shown in FIG. 2*a;*
Figure 3:
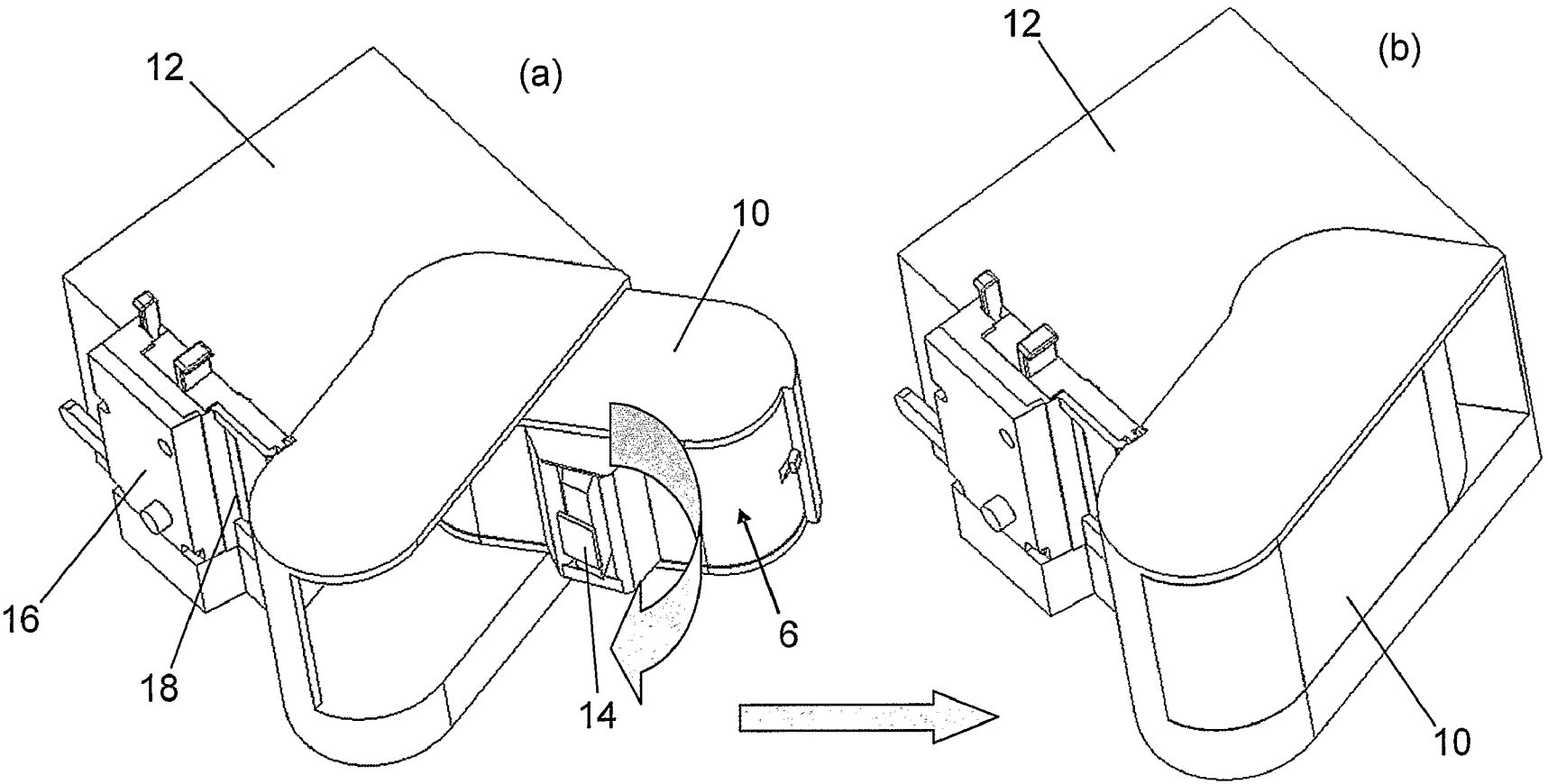
FIG. 3*a* shows a schematic diagram further illustrating loading of the ink ribbon cassette of FIG. 2 with the ink ribbon cassette mounted in a cover of the printer.
FIG. 3*b* shows the printer of FIG. 3*a* with the cover of the printer in a closed position.

FIGS. 1 to 3 show schematic diagrams of a D2-type printing system according to a first embodiment of the invention. The printing system comprises a printer 2, a tape cassette 4 (an embodiment of which is illustrated in more detail in FIGS. 24 to 26 and described later) and an ink ribbon cassette 6 (an embodiment of which is illustrated in more detail in FIGS. 27 to 29 and described later). The printer 2 has a housing comprising two parts which are rotatable relative to each other. In the illustrated embodiment the housing comprises a cover 10 which is rotatable relative to a body 12 of the printer 2. The cover 10 may be a cover. An opening 8 on a side of the body 12 is provided for laterally inserting the tape cassette 4. The tape cassette 4 further comprises a platen roller 11. The cover 10 comprises a printhead 14 mounted thereon. When in an open position as illustrated in FIG. 2*a*, the cover 10 is arranged to receive the ink ribbon cassette 6. Closing the cover 10 having the ink ribbon cassette 6 mounted thereon brings the printhead 14 into engagement with the platen 11 mounted in the tape cassette 4 with ink ribbon and tape disposed therebetween. The closing operation is illustrated in FIGS. 3*a* and 3*b*. A cutter 16 is provided on a side of the tape printer 2 adjacent to a tape exit 18 for cutting a label.

In an alternative arrangement the tape cassette is received in the cover and the ink ribbon cassette is received in the body of the printer. In such an arrangement, the printhead is provided in the body of the printer.

Figure 25:
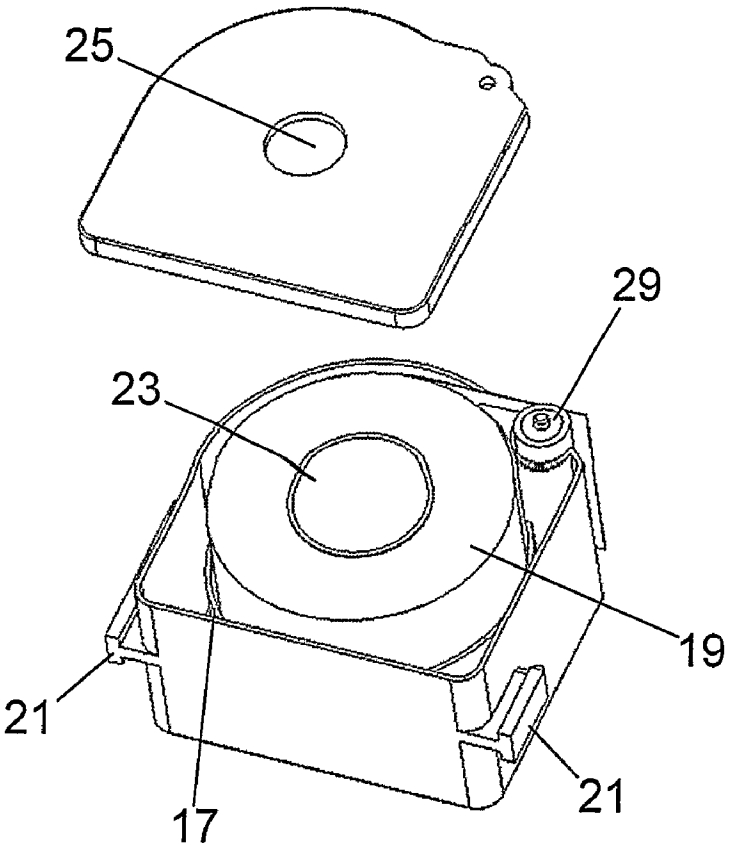
FIG. 25 shows the tape cassette of FIG. 24 with an upper side removed to illustrate the interior of the tape cassette.
Figure 24:
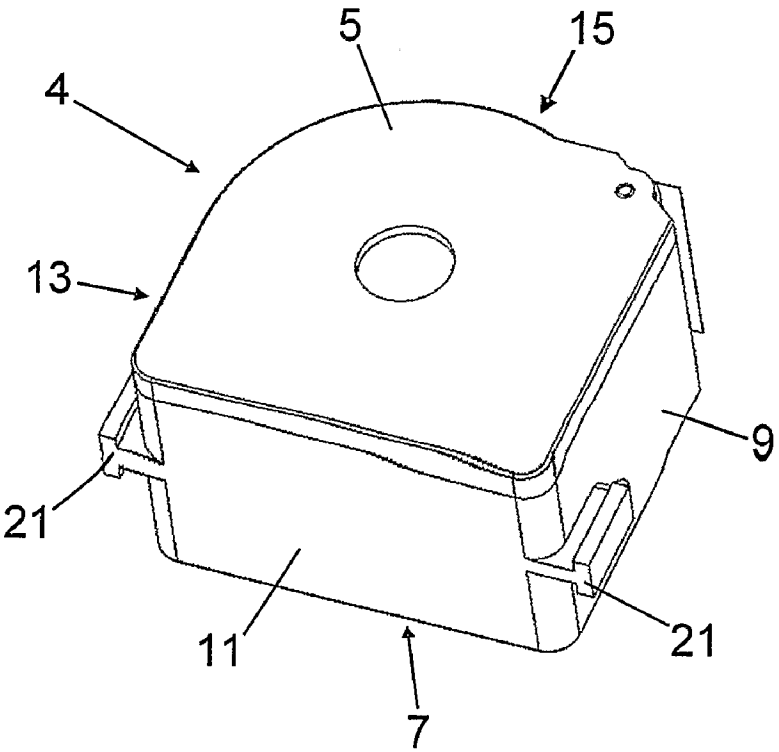
FIG. 24 shows a schematic diagram illustrating a tape cassette.
Figure 26:
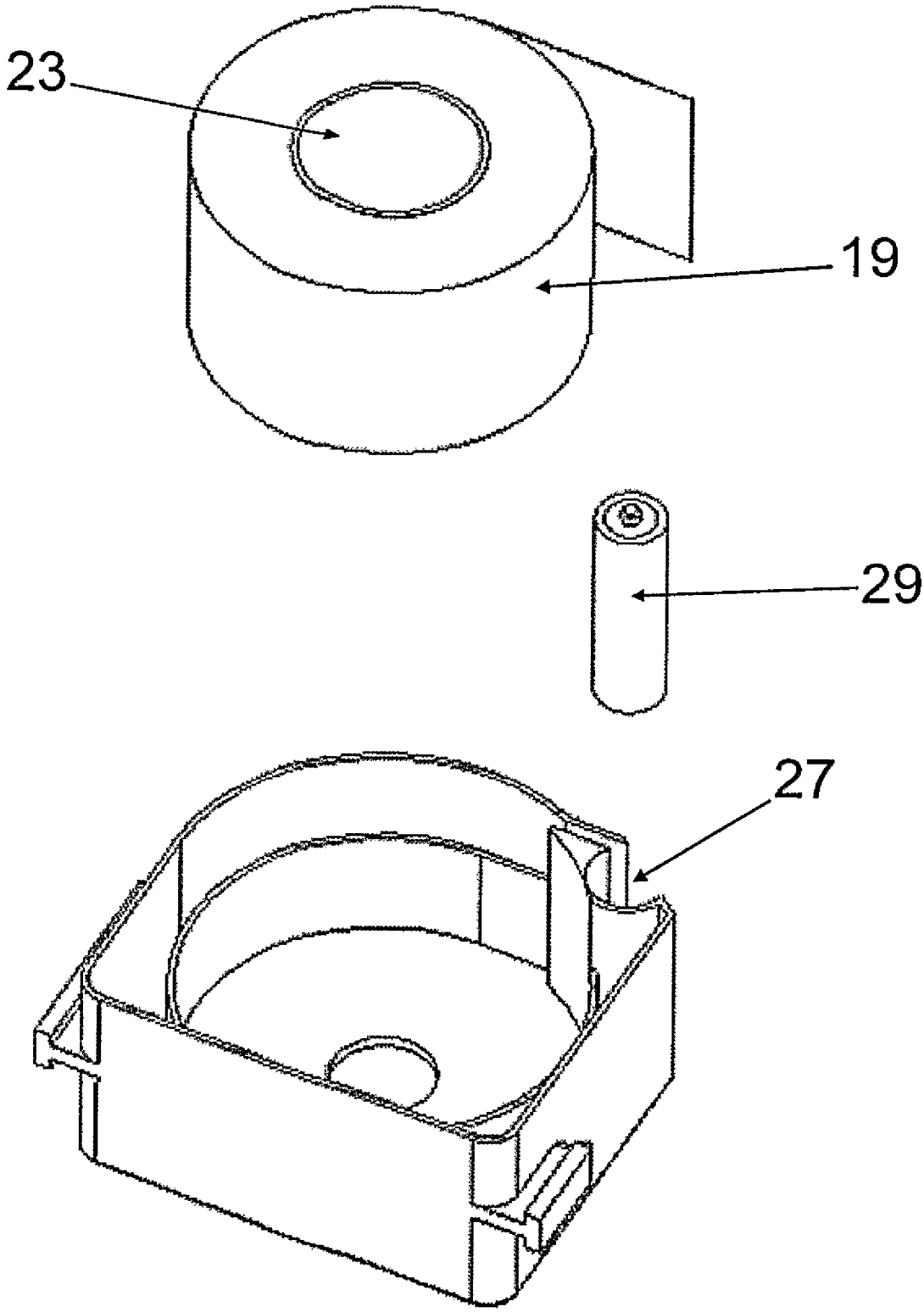
FIG. 26 shows an exploded view of the tape cassette of FIGS. 24 and 25.

An embodiment of the tape cassette is illustrated in FIGS. 24 to 26. The tape cassette 4 comprises a housing which has an upper side 5, a lower side 7 and lateral sides 9, 11, 13, 15. The lower side 7 and the lateral sides 9, 11, 13, 15 are integral and the upper side 5 is attachable thereto for easy construction. The lower side 7 has a curved wall 17 on an inner surface thereof for receiving the tape 19 therein. Two opposed lateral sides 9, 11 have guide members 21 thereon for guiding the tape cassette on insertion into the printer to provide good alignment of the cassette with the printhead in the printer. A tape supply spool 23 is provided within said housing and carries a supply of tape 19. The upper and lower sides have a through hole 25 positioned to correspond to the position of the spool 23 when loaded in the housing. One of said sides 15 has an opening 27 providing a tape exit at a corner of the housing. Adjacent the tape exit, a platen 29 is disposed for cooperation with the printhead 14 in the printer 2. The platen is mounted adjacent said opening between said upper and lower sides for rotational motion with the axis of rotation of said platen being perpendicular to said upper and lower surfaces and also perpendicular to the direction of insertion of said cassette 4 into said printer 2. The tape is arranged to pass from said supply spool and around a portion of said platen such that a portion of tape disposed in the platen is exposed in the opening in the housing for printing thereon.

Figure 28:
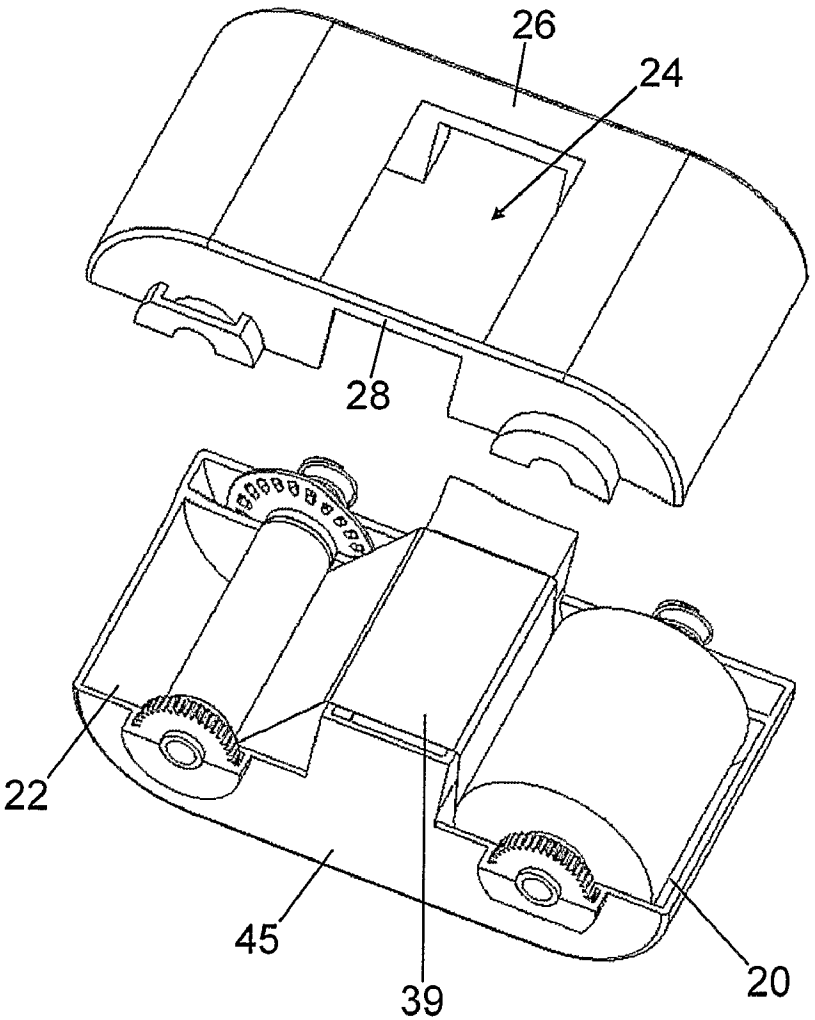
FIG. 28 shows the ink ribbon cassette of FIG. 27 with a front side removed to illustrate the interior of the ink ribbon cassette.
Figure 27:
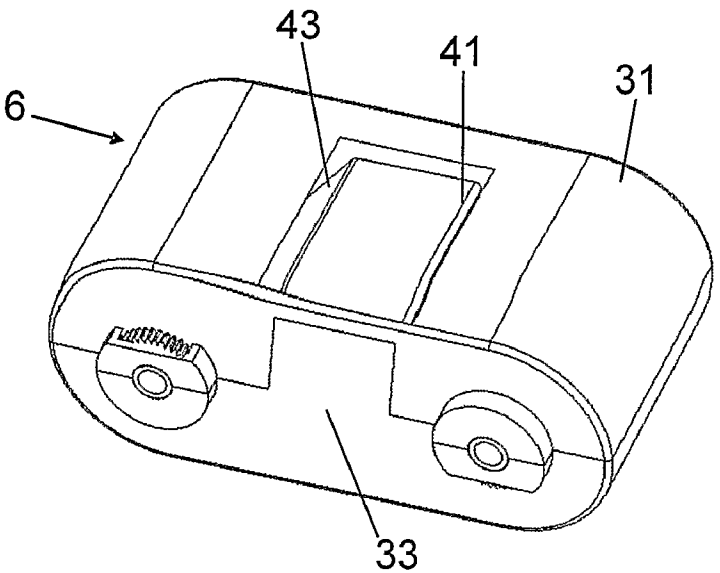
FIG. 27 shows a schematic diagram illustrating an ink ribbon cassette.
Figure 29:
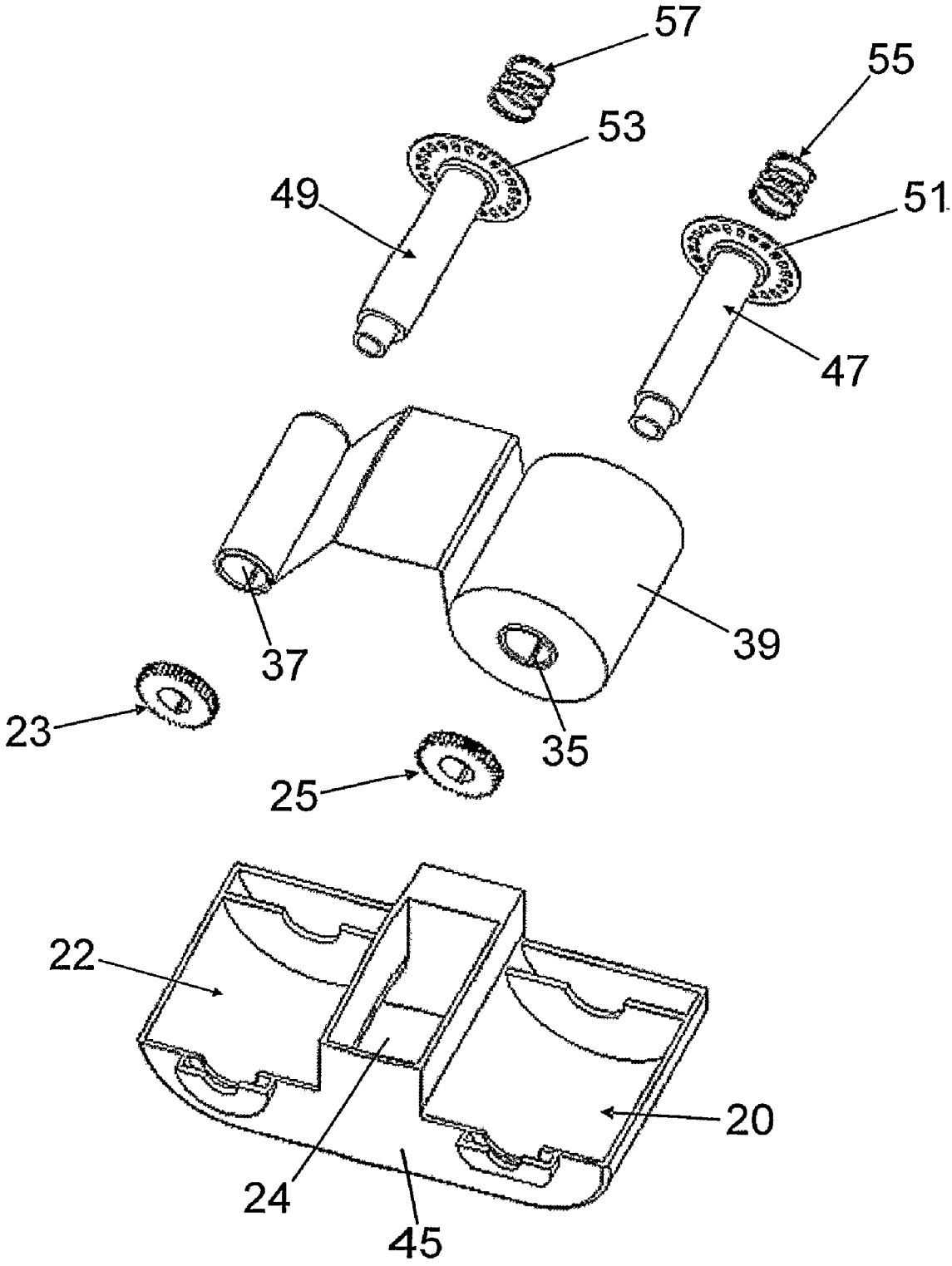
FIG. 29 shows an exploded view of the ink ribbon cassette of FIGS. 27 and 28.

An embodiment of the ink ribbon cassette is illustrated in FIGS. 27 to 29. The ink ribbon cassette 6 comprises a housing having a front and rear parts 31, 33 which are attachable to each other for easy manufacture. The housing has an ink ribbon supply portion 20, an ink ribbon take-up portion 22 and an opening 24 therebetween. The ink ribbon supply portion 20 houses an ink ribbon supply spool 35 while the ink ribbon take up portion 22 houses an ink ribbon take up spool 37. The ink ribbon supply spool 35 carries a supply of ink ribbon 39. The ink ribbon 39 passes through a slit 41 in the ink ribbon supply portion 20 of the housing and across the opening 24 between the ink ribbon supply portion 20 and the ink ribbon take-up portion 22 of the housing. The ink ribbon passes through a slit 43 in the ink ribbon take-up portion 22 of the housing to the ink ribbon take-up spool 37 housed therein. The ink ribbon supply portion 20 of the housing and the ink ribbon take-up portion 22 of the housing are connected at upper and lower sides by upper and lower cross members 26, 28. In the particular embodiment illustrated in FIG. 2, the upper cross member 28 is integral with an upper surface 30 of the housing. The upper surface passes over the opening 24 between the two portions 20, 22 of the housing and provides extra strength to prevent the cross members snapping during handling. A lower surface 45 may also be provided, as shown in FIGS. 27 to 29, passing under the opening 24 between the two portions of the housing to add further strength to the housing of the cassette. The cross members 26, 28 form a substantially rectangular window with sides of the ink ribbon supply portion 20 and ink ribbon take-up portion 22 of the housing. The opening 24 in the body of the cassette extends over the entire width of the cassette body from a rear side to a front side in a direction perpendicular to axes of rotation of the spools 35, 37. The ink ribbon 39 passes across the substantially rectangular window whereby in use the print head 14 in the printer 2 passes through the opening 24 in the housing and cooperates with the ink ribbon in the window for printing.

The housing of the ink ribbon cassette further comprises a locking mechanism 32 as shown in FIG. 2*b* which cooperates with the housing of the printer to hold the cassette 6 in place. In the embodiment illustrated in FIG. 2, the locking mechanism 32 comprises an opening in the side of the cassette housing which cooperates with a projection 34 mounted on the housing of the printer 2 to form a snap-fit holding feature. In the illustrated embodiment, the projection is mounted on the cover 10 of the printer 2 for holding the cassette 6 in a cassette receiving portion in the cover of the printer.

The ink ribbon cassette further comprises a gear 23 coupled to said ink-ribbon take-up spool 37 at a lower portion thereof for coupling with a drive gear in a tape printer for printing. The ink ribbon cassette further comprises a gear 25 coupled to said ink-ribbon supply spool 35 at a lower portion thereof for coupling with a drive gear in a tape printer. This mechanism allows for rewinding of the ink ribbon and also can be utilized to pre-tension the ink ribbon prior to printing. The ink ribbon cassette further comprises two sprockets 47, 49 with flanges 51, 53, the sprockets being coupled to the ink-ribbon supply spool 35 and the ink ribbon take up spool 37 respectively. The sprockets are biased by helical springs 55, 57 to form a rewind brake.

The cassette receiving portion of the cover comprises two cavities 36, 38 with a printhead mounting portion 40 therebetween. The print head mounting portion 40 passes from a lower surface of the cover 10 to a position spaced apart from the upper surface of the cover 10. A gap is therefore provided between the print head mounting portion 40 and the upper surface of the cover 10 for accommodating the upper surface 30 of the ink ribbon cassette 6. In an alternative embodiment in which an ink ribbon cassette is provided with a lower surface, a gap is also provided between the print head mounting portion and the lower surface of the cover for accommodating the lower surface of the ink ribbon cassette.

The print head 14 is mounted on the print head mounting portion 40. When the ink ribbon cassette 6 is inserted in the cassette receiving portion, the ink ribbon supply portion 20 of the cassette housing is accommodated in one of the cavities 36 of the cassette receiving portion and the ink ribbon take-up portion 22 of the cassette housing is accommodated in the other one of the cavities 38 of the cassette receiving portion. The print head mounting portion 40 passes through the opening 24 between the two portions of the cassette 20, 22 whereby the printhead 14 is disposed against the ink ribbon in the window of the cassette housing. The snap-fit mechanism 32, 34 holds the cassette 6 in the cassette receiving portion in this position. When the cover 10 is closed as illustrated in FIGS. 3*a* and 3*b*, the printhead 14 cooperates with the platen in the tape cassette 4 with the tape and ink ribbon disposed therebetween for printing.

The tape passes though a tape exit 18 comprising an opening in a side of the body 12 of the printer 2 and after printing a printed label is cut from the tape by operation of a cutting mechanism 16 located adjacent the tape exit 18.

FIGS. 4 to 7 show schematic diagrams of a D2-type printing system according to a second embodiment of the invention. The printing system comprises a similar structure to that of the first embodiment. The second embodiment differs from the first embodiment in that the ink ribbon cassette 106 is not mounted directly in the cover 10 carrying the printhead 14, but rather is mounted in an ink ribbon cassette holder 42 which moves together with the cover 10 when opening the cover, but with limited rotation relative to the cover. When closing the cover 10, the ink ribbon cassette holder 42 holding the ink ribbon cassette 106 is engaged by the cover 10 and is pushed into a closed position with the printhead 14 passing through an opening in the holder 42 and ink ribbon cassette 106 to co-operate with the platen roller in the tape cassette 4.

Figure 4:
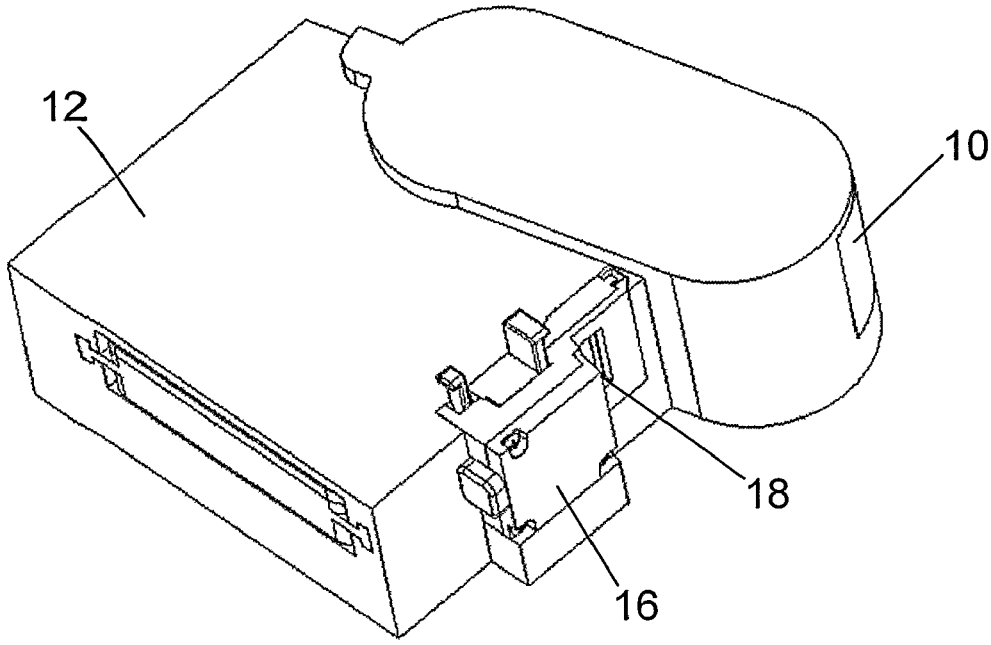
FIG. 4 shows a schematic diagram of a D2-type printing system according to a second embodiment of the invention.
Figure 5:
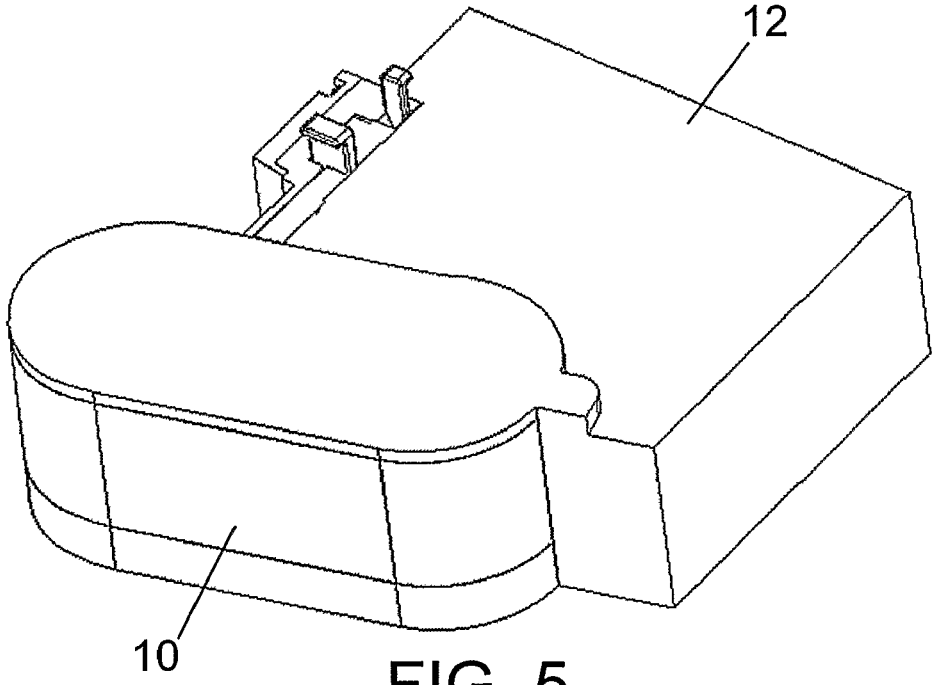
FIG. 5 shows another view of the embodiment shown in FIG. 4.
Figure 6:
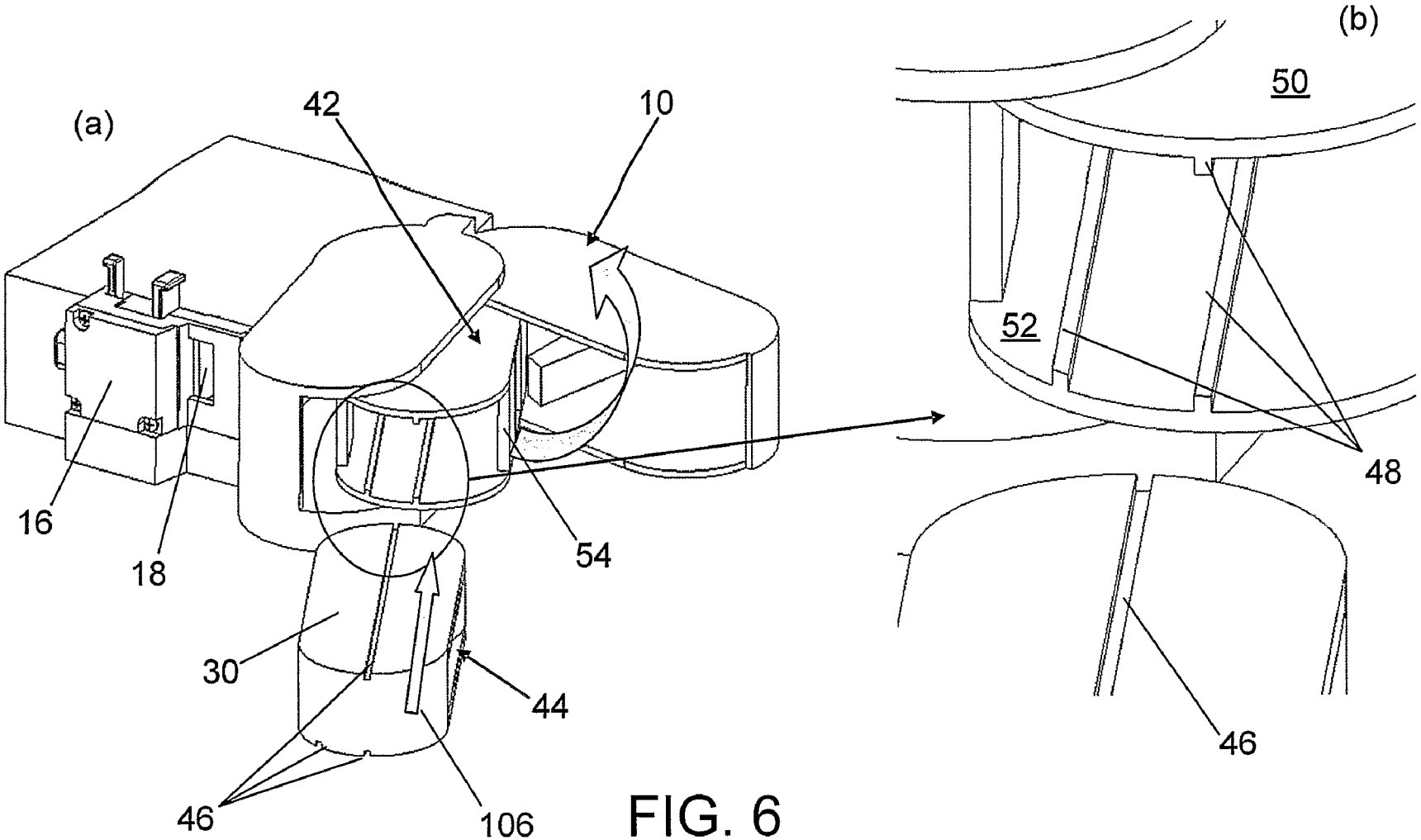
FIG. 6*a* shows a schematic diagram illustrating loading or an ink ribbon cassette in the embodiment of FIGS. 4 and 5.
FIG. 6*b* shows an enlarged portion of FIG. 6*a* illustrating alignment members in an ink ribbon cassette holder and on the ink ribbon cassette.
Figure 7:
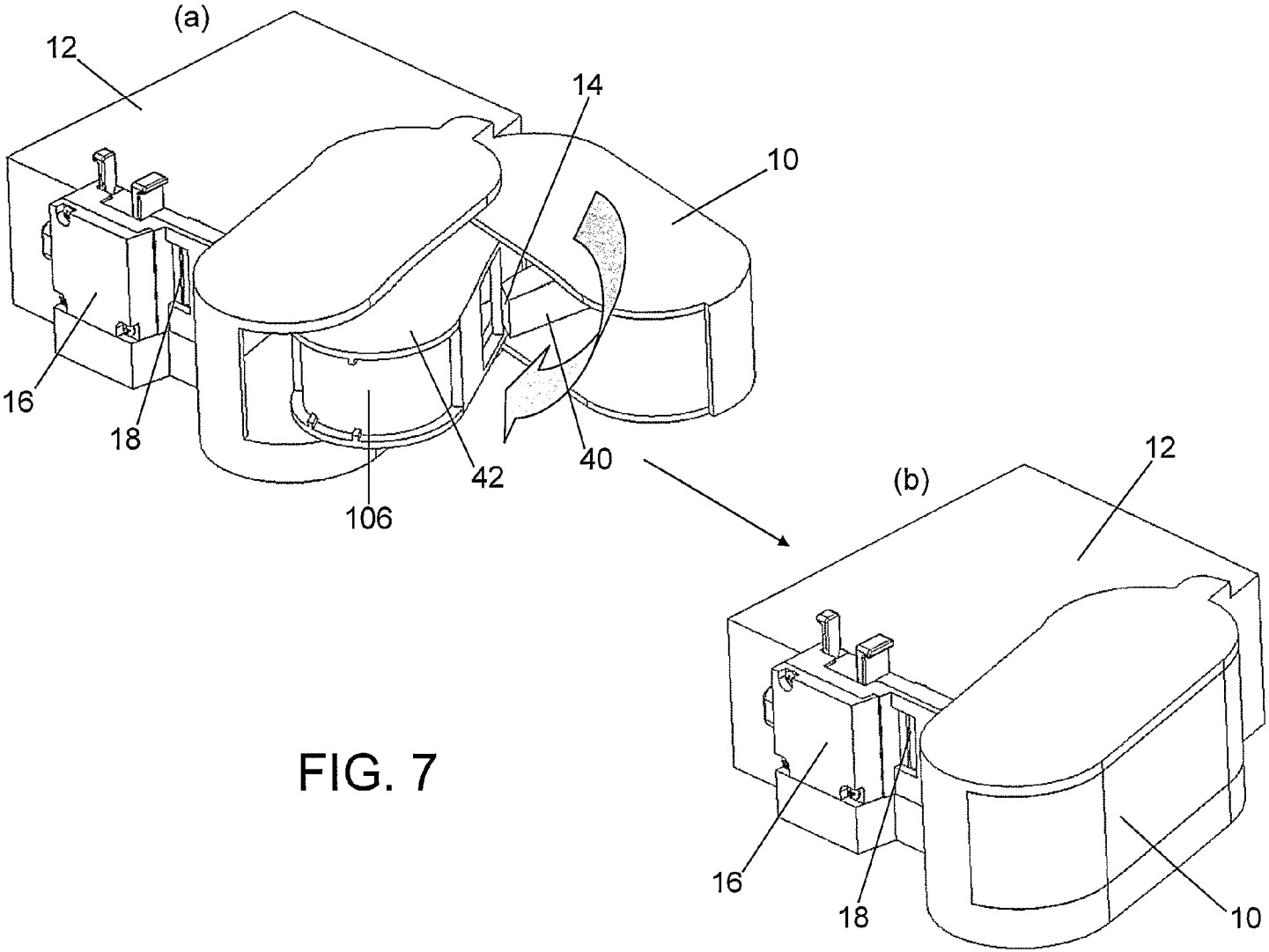
FIG. 7*a* shows a schematic diagram further illustrating loading of the ink ribbon cassette of FIG. 6, with the ink ribbon cassette in the ink ribbon cassette holder and a cover in an open position.
FIG. 7*b* shows the printer of FIG. 7*a* with the cover in a closed position.

FIGS. 4 and 5 illustrate two views of the printer 2 with a tape cassette 4 and an ink ribbon cassette 106 mounted therein. FIG. 6 illustrates how the ink ribbon cassette 106 is mounted in the printer 2.

The ink ribbon cassette 106 is similar in structure to that previously described in relation to the first embodiment. The housing has the same two portion structure with an opening therebetween. In the embodiment illustrated in FIGS. 6*a* and 6*b*, the cassette has an upper surface 30 extending over the opening between the two housing portions and a lower surface 44 extending below the opening between the two housing portions. One or more alignment members 46 are provided on the housing of the cassette for cooperation with alignment members 48 in the ink ribbon cassette holder of the printer for correctly aligning the ink ribbon cassette. In the illustrated embodiment, the alignment members 46 comprise grooves in the upper and lower surfaces of the cassette which cooperate with ribs 48 in the cassette holder in the printer. An alternative would be to provide ribs on the cassette and grooves in the cassette holder.

The ink ribbon cassette holder comprises an upper surface 50, a lower surface 52 and two wall portions 54 disposed therebetween on one side of the holder. An opening is provided between the two wall portions on said one side through which the printhead passes when the cover is closed. In another embodiment two further wall portions may be provided on an opposite side of the holder to said wall portions 54, with an opening therebetween through which the printhead may pass when the cover is closed. The cassette holder 42 is mounted in the body 12 of the printer for limited rotation relative to the body whereby when the cover 10 is opened the cassette holder rotates though an angle less than the angle through which the cover rotates. The cassette holder 54 and the cover 10 are mounted on a common axis for rotation. The cover 10 can rotate through an angle of up to approximately 90° but more usually up to 70° and more usually still up to 50°. The holder 54 can rotate though an angle of up to 45° but more usually up to 35° and more usually still up to 25°, i.e. approximately half the angle though which the cover rotates.

The cover 10 has a similar structure to that previously described in relation to the first embodiment. That is, the cover 10 comprises a receiving portion having two cavities 36, 38 with a print head support portion 40 therebetween. A gap is provided between the print head mounting portion and the lower surface of the cover for accommodating the lower surface of the ink ribbon cassette holder and the lower surface of the ink ribbon cassette 106. Another gap is provided between the print head mounting portion and the upper surface of the cover for accommodating the upper surface of the ink ribbon cassette holder and the upper surface of the ink ribbon cassette 106.

FIGS. 7*a* and 7*b* show the operation of closing the cover 10. FIG. 7*a* shows the printer in an open position. On closing, the cover is rotated in a clockwise direction thus causing the print head 14 mounted on the print head mounting portion 40 to pass though the opening in the cassette holder 42 and the opening in the ink ribbon cassette 106. As the cover 10 is rotated it cooperates with the cassette holder 42 thereby receiving the cassette holder and the cassette in the receiving portion and pushing the cassette within the holder into its printing position. In this closed position shown in FIG. 7*b*, the print head cooperates with the platen in the tape cassette 4 with the tape and ink ribbon disposed therebetween. The cover 10 holds the ink ribbon cassette 106 in this position after closing.

While the first embodiment is more simple in design and construction than the second embodiment and is therefore easier and cheaper to manufacture, the holder of the second embodiment may provide improved alignment of the ink ribbon cassette when in the printing position thereby improving print quality. The second embodiment may also provide an easier and more user friendly arrangement for loading the ink ribbon cassette into the printer.

Figure 8:
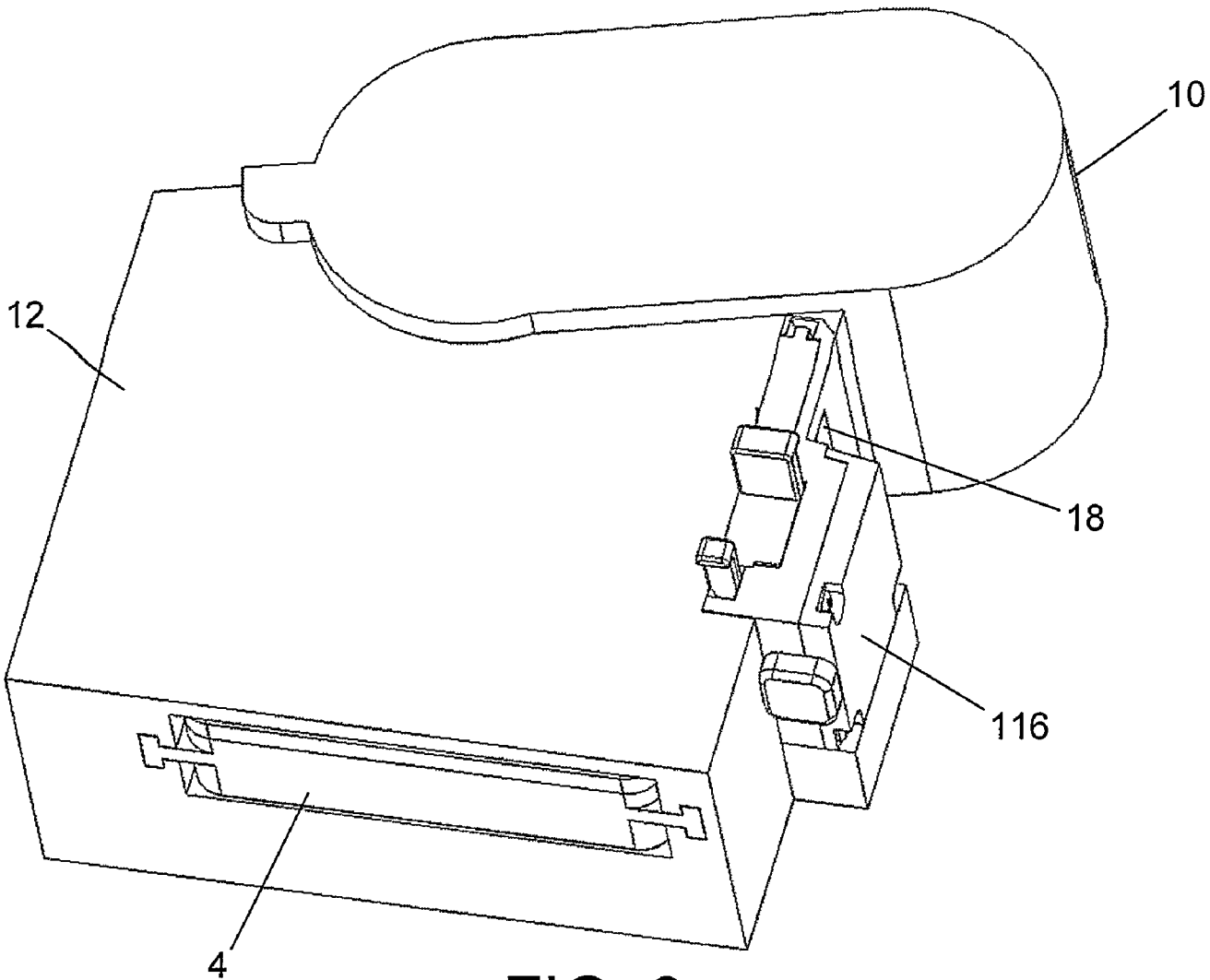
FIG. 8 shows the embodiment of FIGS. 4 to 7 with an alternate cutting unit.
Figure 9:
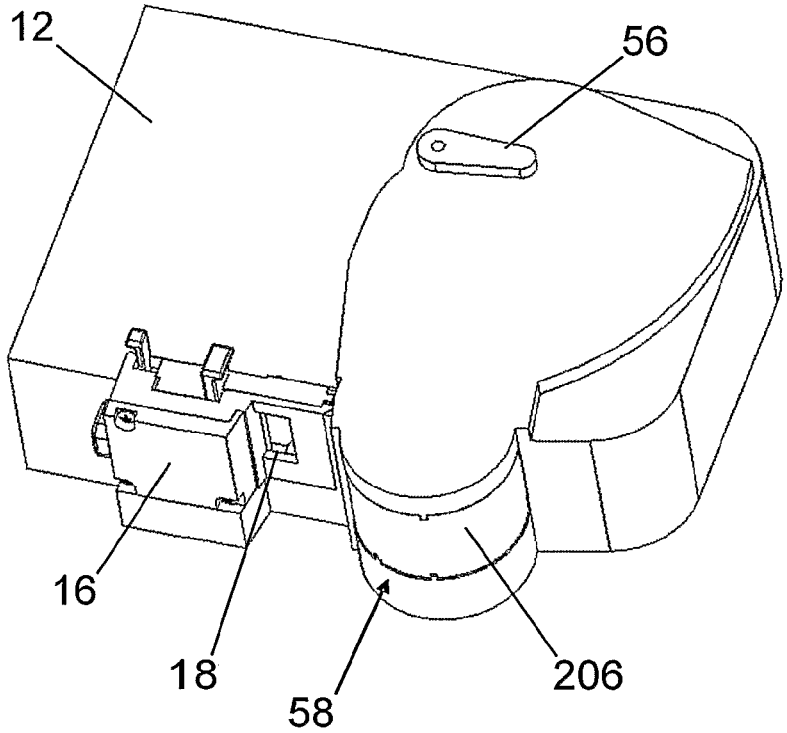
FIG. 9 shows a schematic diagram of a D2-type printing system according to a third embodiment of the invention.
Figure 10:
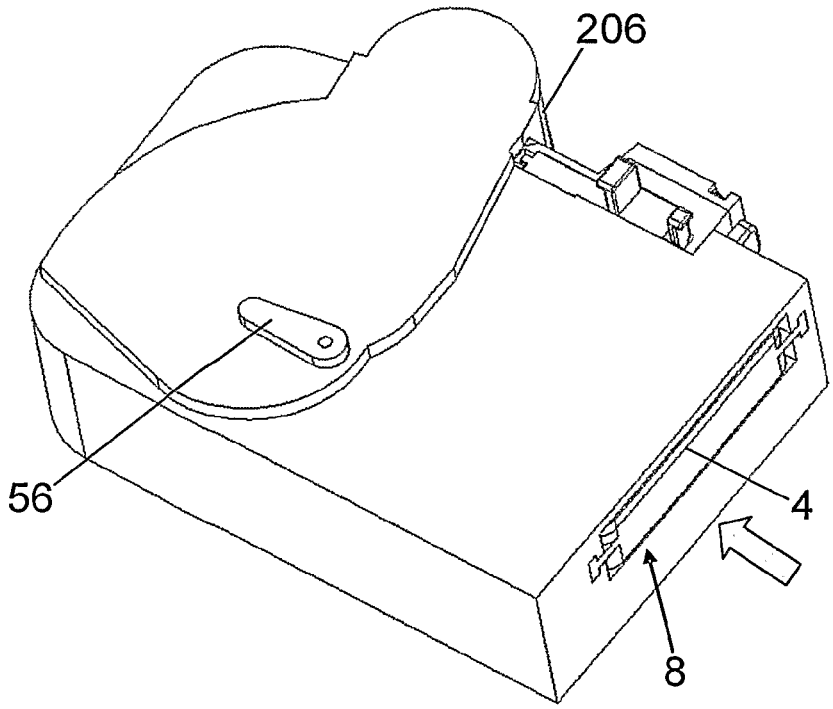
FIG. 10 shows another view of the embodiment shown in FIG. 9.

FIG. 8 shows the embodiment of FIGS. 4 to 7 with an alternate cutting unit 116 which is more compact.

FIGS. 9 to 15 show schematic diagrams of a D2-type printing system according to a third embodiment of the invention. The printing system comprises a tape cassette 4, a tape printer and an ink ribbon cassette 206. The tape printer has an opening 8 in a side thereof for laterally inserting the tape cassette 4. The tape printer has another opening 58 for lateral insertion of the ink ribbon cassette 206. The tape printer further comprises a printhead 14 mounted on a rotatable mechanism 60 for rotating the printhead into a printing position via a lever 56 mounted for rotation on the printer. The printhead 14 passes through an opening in the ink ribbon cassette 206 to co-operate with the platen mounted in the tape cassette 4 such that the tape and ink ribbon are disposed therebetween.

The structure of the tape cassette 4 and the ink ribbon cassette 206 is similar to that described previously in the first and second embodiments.

The printer differs from those described in the first and second embodiments in that the ink ribbon cassette 206 is not mounted in a cover but rather is mounted directly in the body of the printer. The housing of the printer does not comprise two parts which are rotatable relative to each other, but rather comprises a single body 12. An ink ribbon cassette receiving portion 58 is provided in the body. This is similar in structure to the ink ribbon cassette holder described in relation to the second embodiment and is illustrated in FIGS. 11 and 12.

Figure 12:
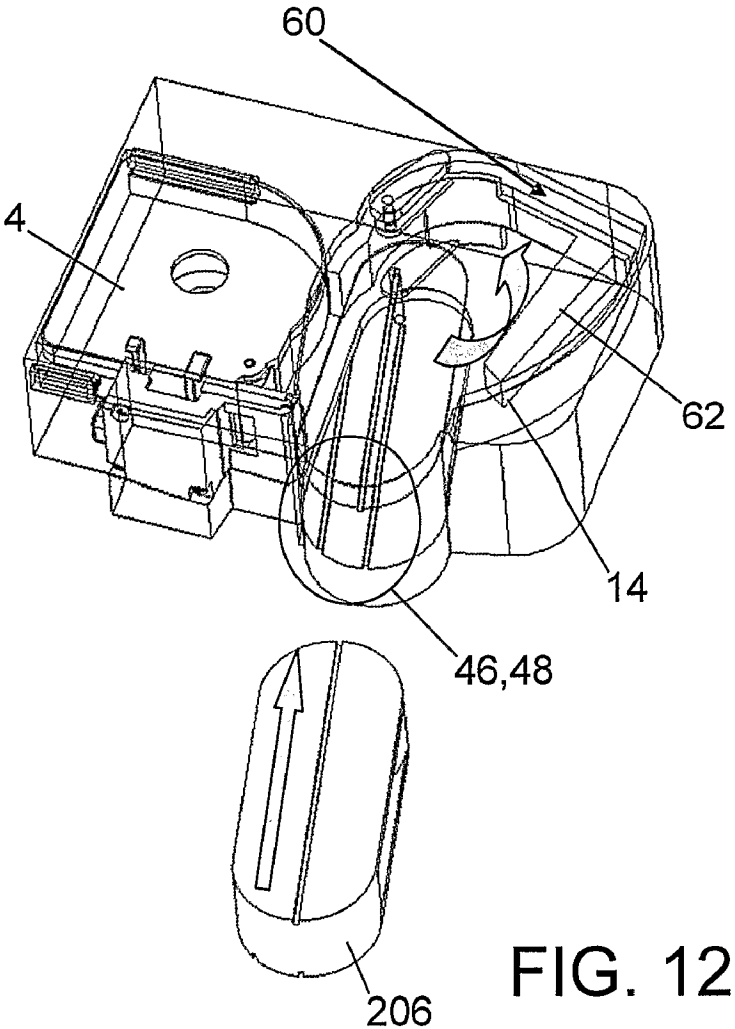
FIG. 12 shows another view similar to that of FIG. 11 but with the housing transparent to show the internal features of the printer.
Figure 11:
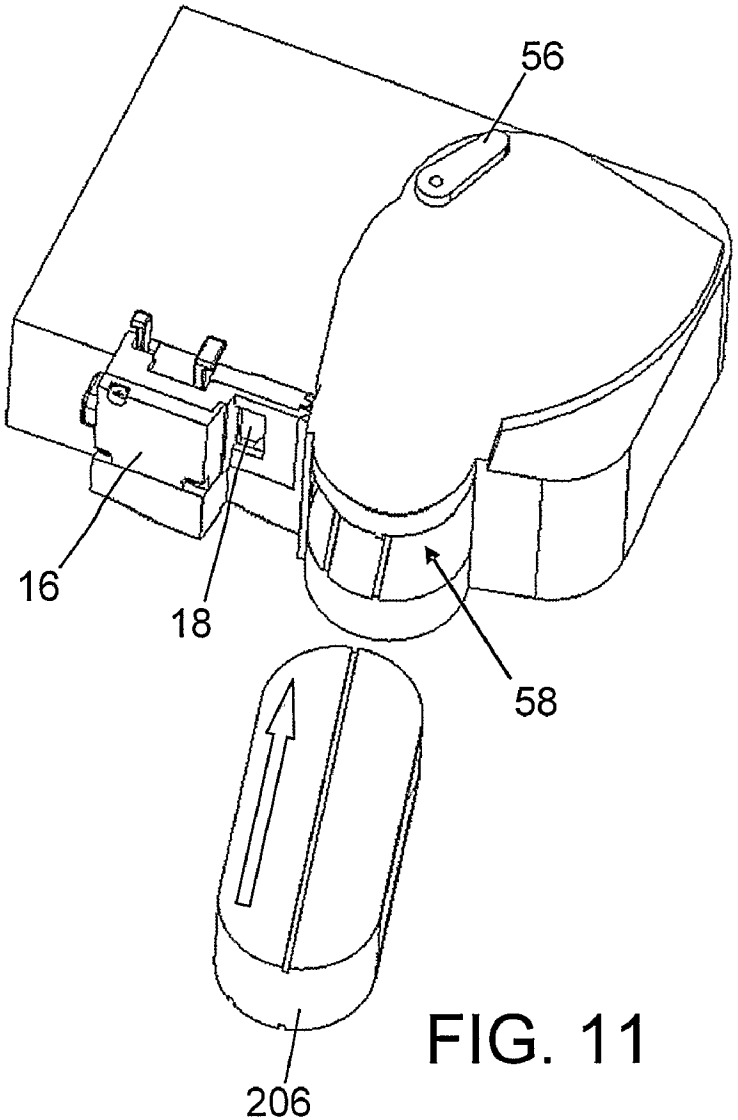
FIG. 11 shows a schematic diagram illustrating loading of an ink ribbon cassette in the embodiment of FIGS. 9 and 10.
Figure 13:
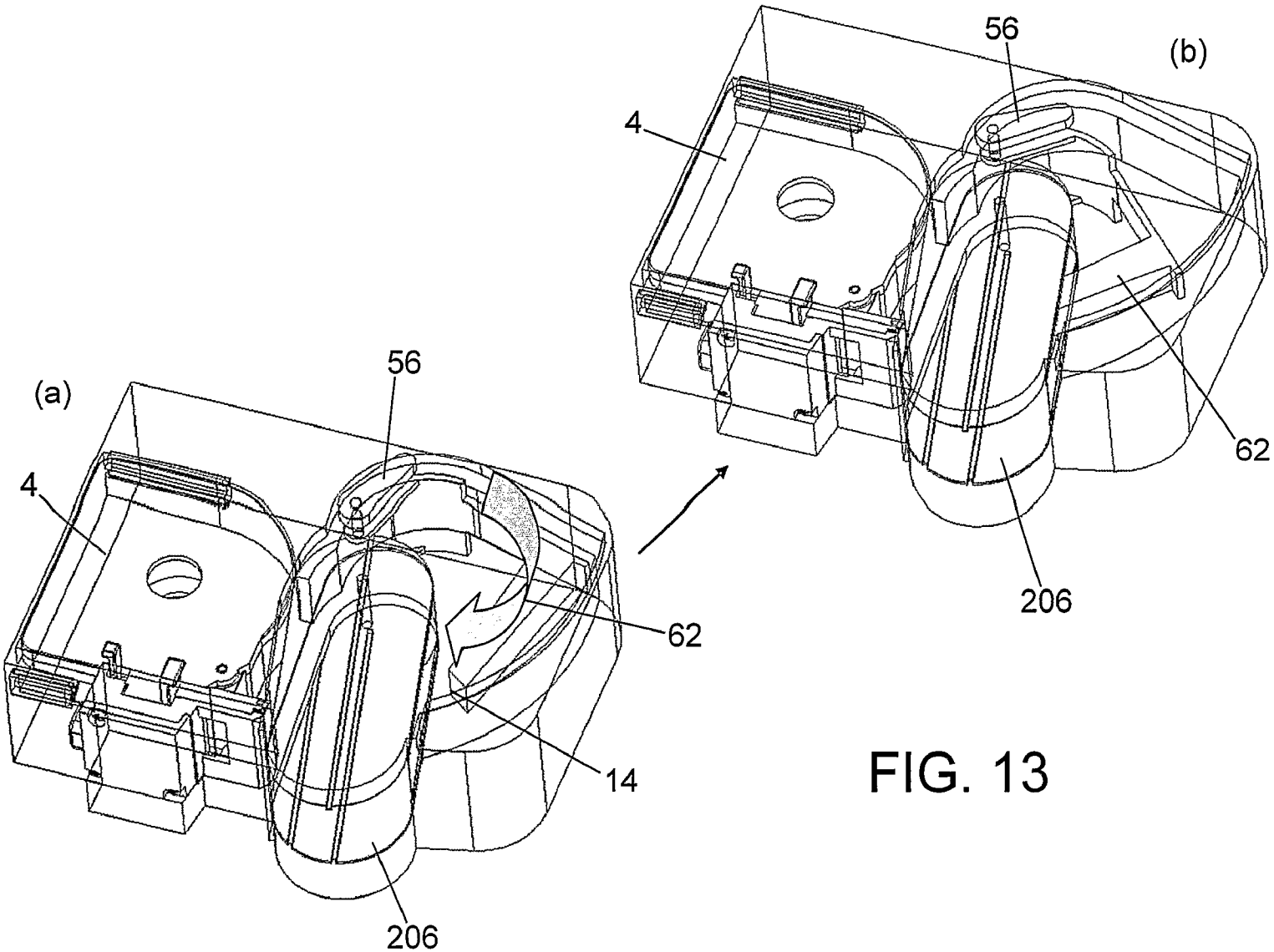
FIG. 13*a* shows a schematic diagram illustrating the movement of a printhead into a printing position in the embodiment illustrated in FIGS. 9 to 12, with the printhead in a non-printing position.
FIG. 13*b* shows the printer of FIG. 13*a* with the printhead in an intermediate position between the non-printing position and a printing position.
Figure 15:
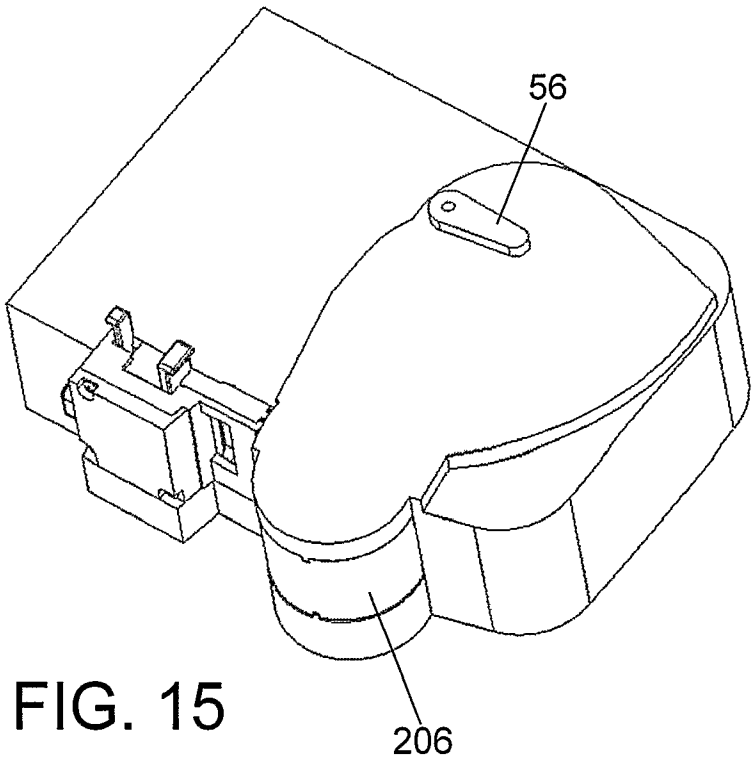
FIG. 15 shows the schematic diagram of FIG. 14 but without the printer housing made transparent.
Figure 14:
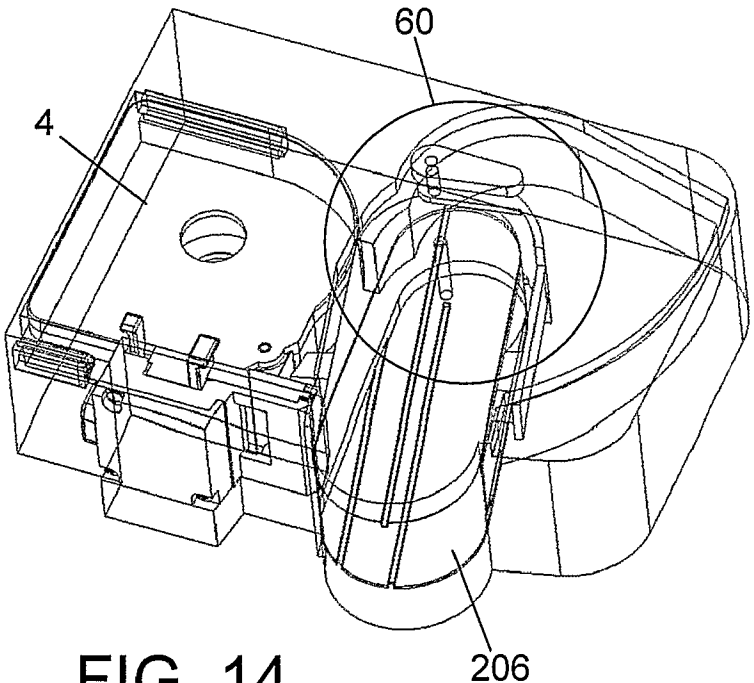
FIG. 14 shows a schematic diagram of the printhead in its printing position with the housing of the printer made transparent for clarity.

FIGS. 11 and 12 illustrate the rotatable mechanism 60 on which the printhead 14 is mounted. In a first position illustrated in FIGS. 11 and 12, the printhead 14 is positioned on an opposite side of said ink ribbon cassette receiving portion 58 to the tape cassette receiving portion 8. After inserting the ink ribbon cassette 206 into the receiving portion in the printer, the mechanism 60 is rotated in a clockwise direction by a lever 56 whereby the printhead 14 mounted on an arm 62 of the mechanism 60 passes through the opening in the ink ribbon cassette as shown in FIG. 13 to cooperate with the platen in the tape cassette 4 with the tape and ink ribbon disposed therebetween. In the printing position, the rotatable mechanism holds/clamps the ink ribbon cassette in position as shown in FIGS. 14 and 15.

As the third embodiment does not comprise a two part housing as compared with the first and second embodiments it may be easier and cheaper to manufacture. Furthermore, as the ink ribbon cassette receiving portion is fixed rather than movable relative to the body of the printer in the third embodiment, this may aid in more consistent alignment.

FIGS. 16 to 23 show schematic diagrams of a D2-type printing system according to a fourth embodiment of the invention. The fourth embodiment is similar in construction to the third embodiment, the difference being in the structure of the mechanism on which the printhead 14 is mounted. In the third embodiment, the printhead is mounted on a rotatable mechanism 60. In contrast, in the fourth embodiment the printhead is mounted on a mechanism 64 which moves along a straight line in a direction which is perpendicular to a line of printing elements on the printhead and which is perpendicular to the axis of rotation of the platen in the tape cassette when the tape cassette is loaded in the printer. The mechanism comprises a lever 64 which is moveable in and out of an opening in the tape printer body 12. After inserting the ink ribbon cassette 306 and tape cassette 4 into the printer, pushing the lever 64 in an inwards direction causes the printhead 14 to pass though an opening in the ink ribbon cassette 306 and co-operate with the platen in the tape cassette with the tape and ink ribbon disposed therebetween.

Figure 17:
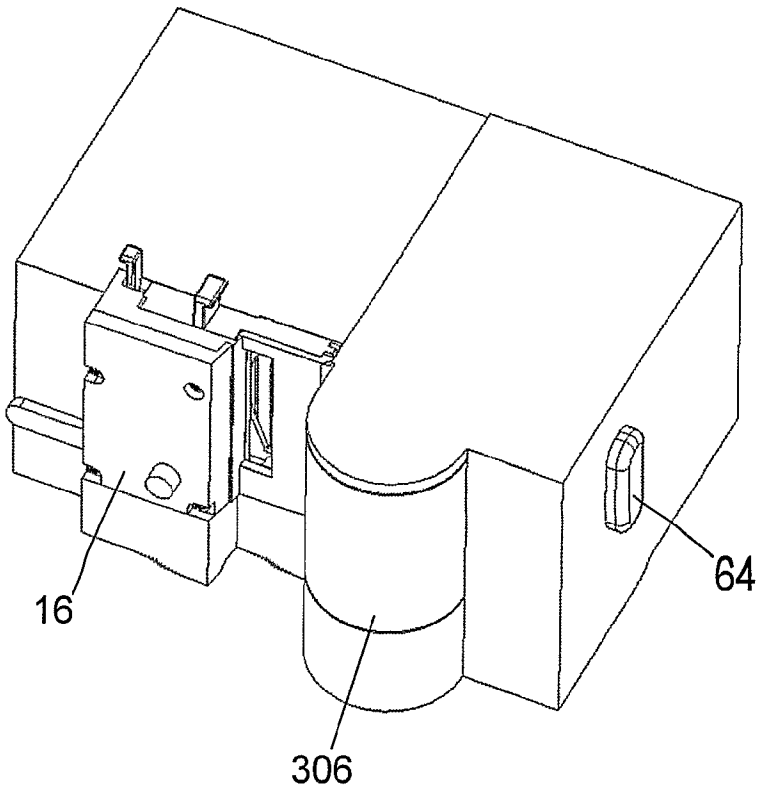
FIG. 17 shows a different view of the fourth embodiment of the invention.
Figure 16:
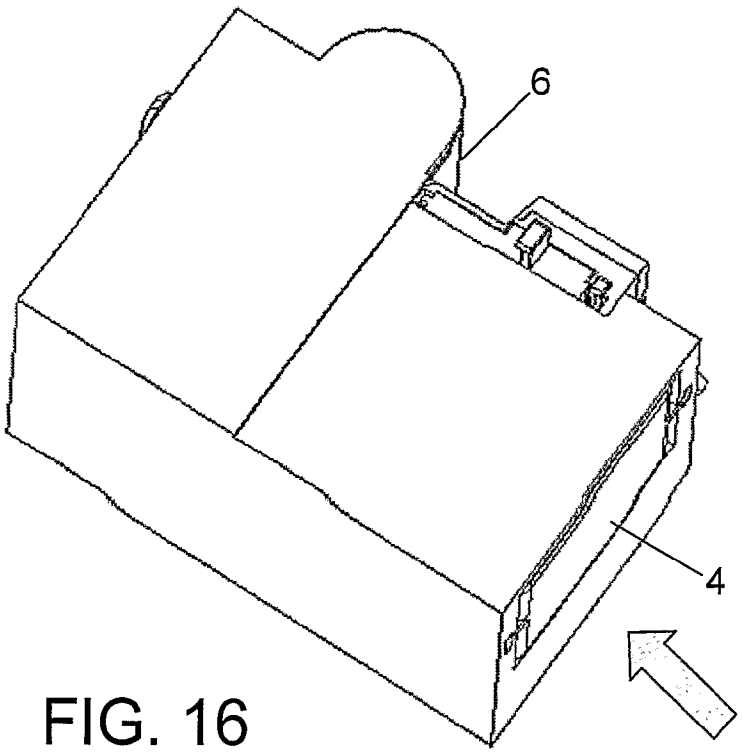
FIG. 16 shows a schematic diagram of a D2-type printing system according to a fourth embodiment of the invention.

FIGS. 16 and 17 show two general views of the printing system in its printing arrangement with the tape cassette 4 and the ink ribbon cassette 306 mounted in the printer and the printhead mechanism 64 in its locked printing position.

Figure 19:
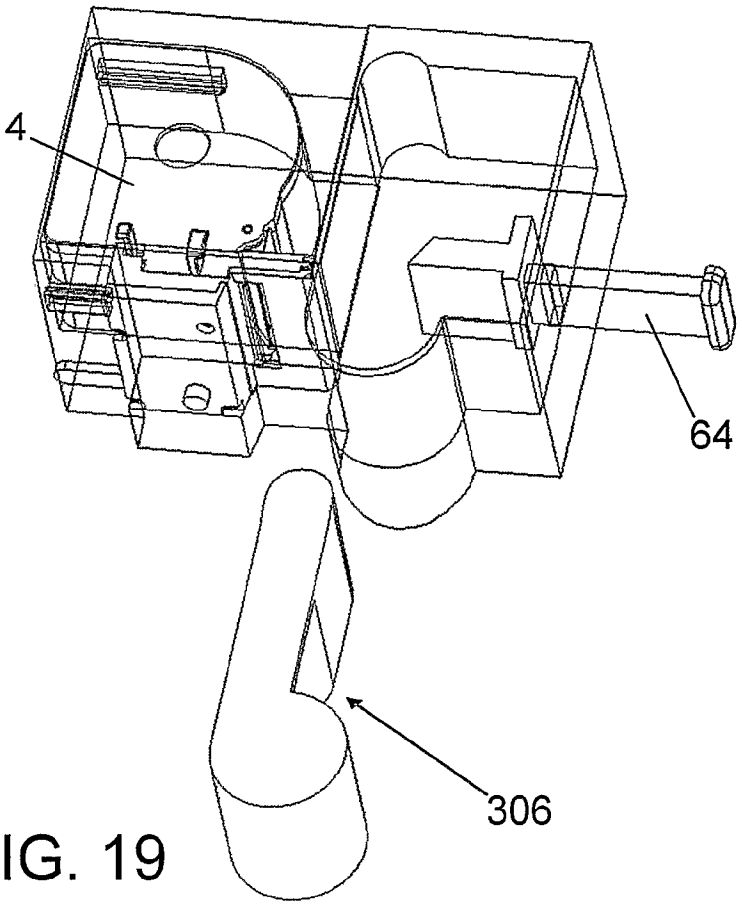
FIG. 19 shows the schematic diagram of FIG. 18 with the printer housing made transparent for clarity.
Figure 18:
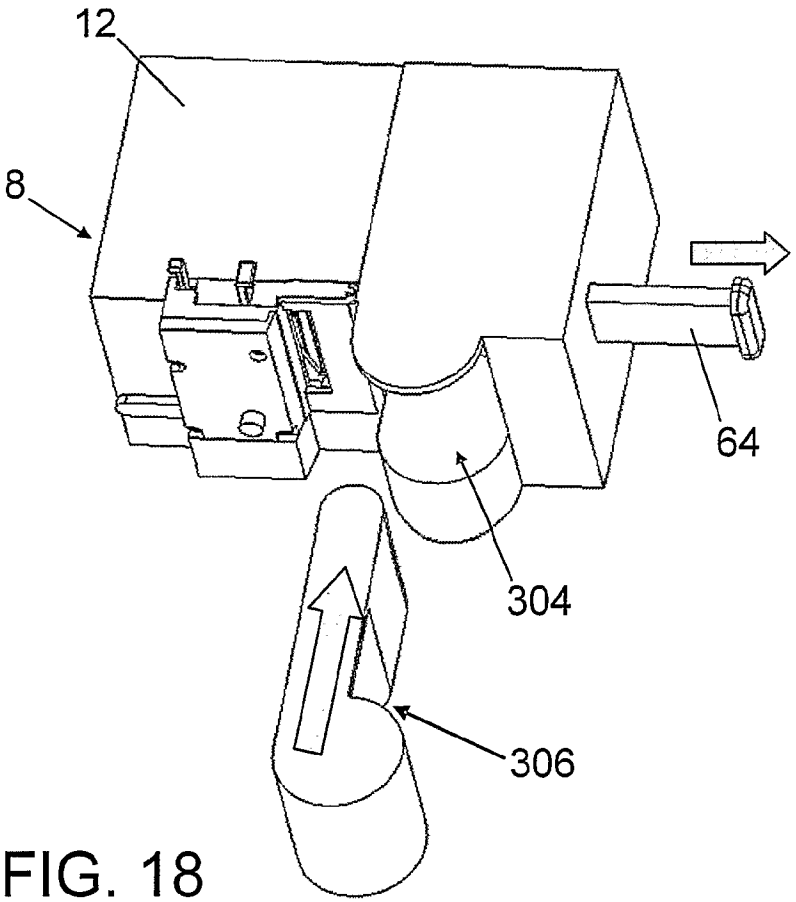
FIG. 18 shows a schematic diagram illustrating loading of an ink ribbon cassette in the embodiment of FIGS. 16 and 17.
Figure 20:
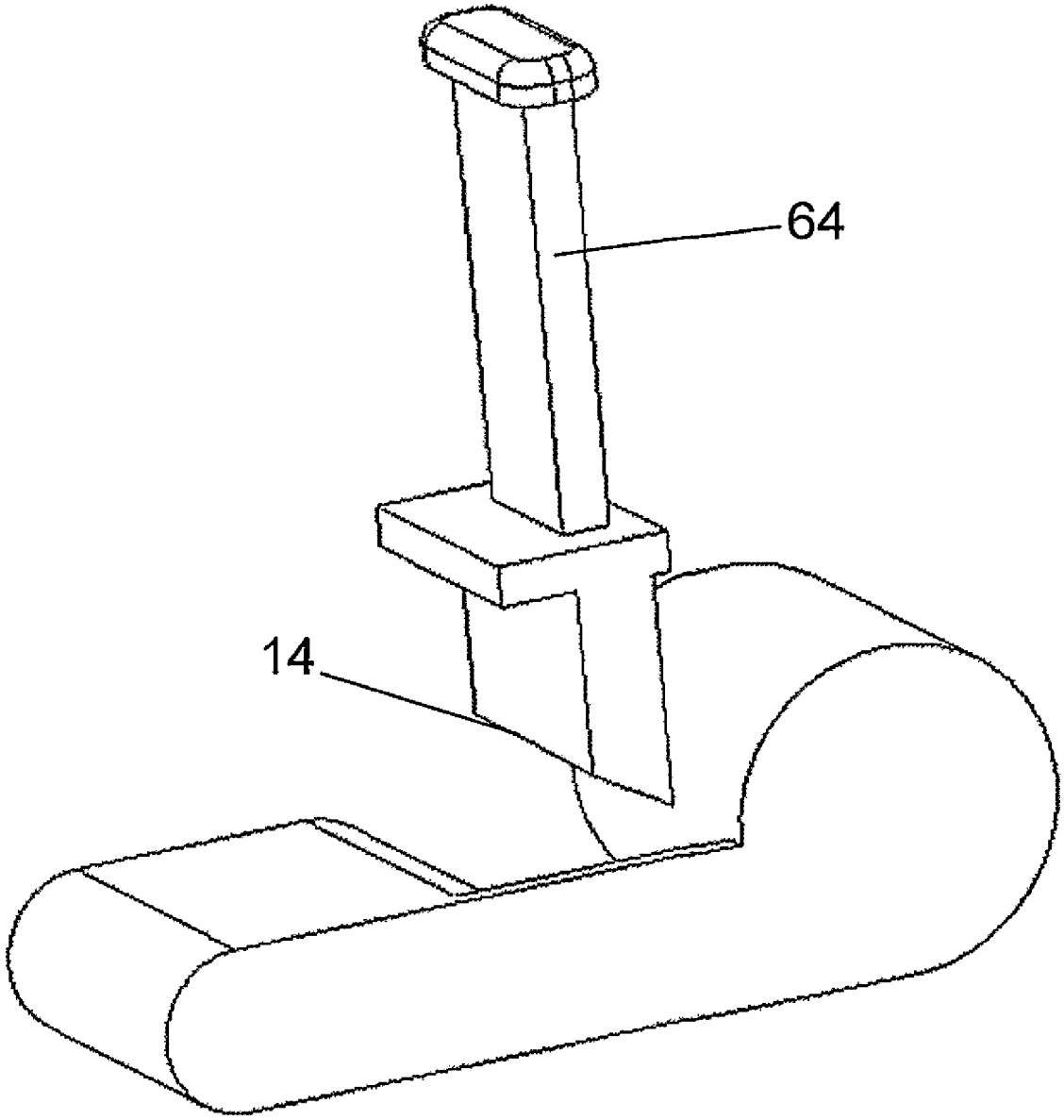
FIG. 20 shows a schematic diagram illustrating the ink ribbon cassette and printhead of the arrangement shown in FIGS. 16 to 19.
Figure 21:
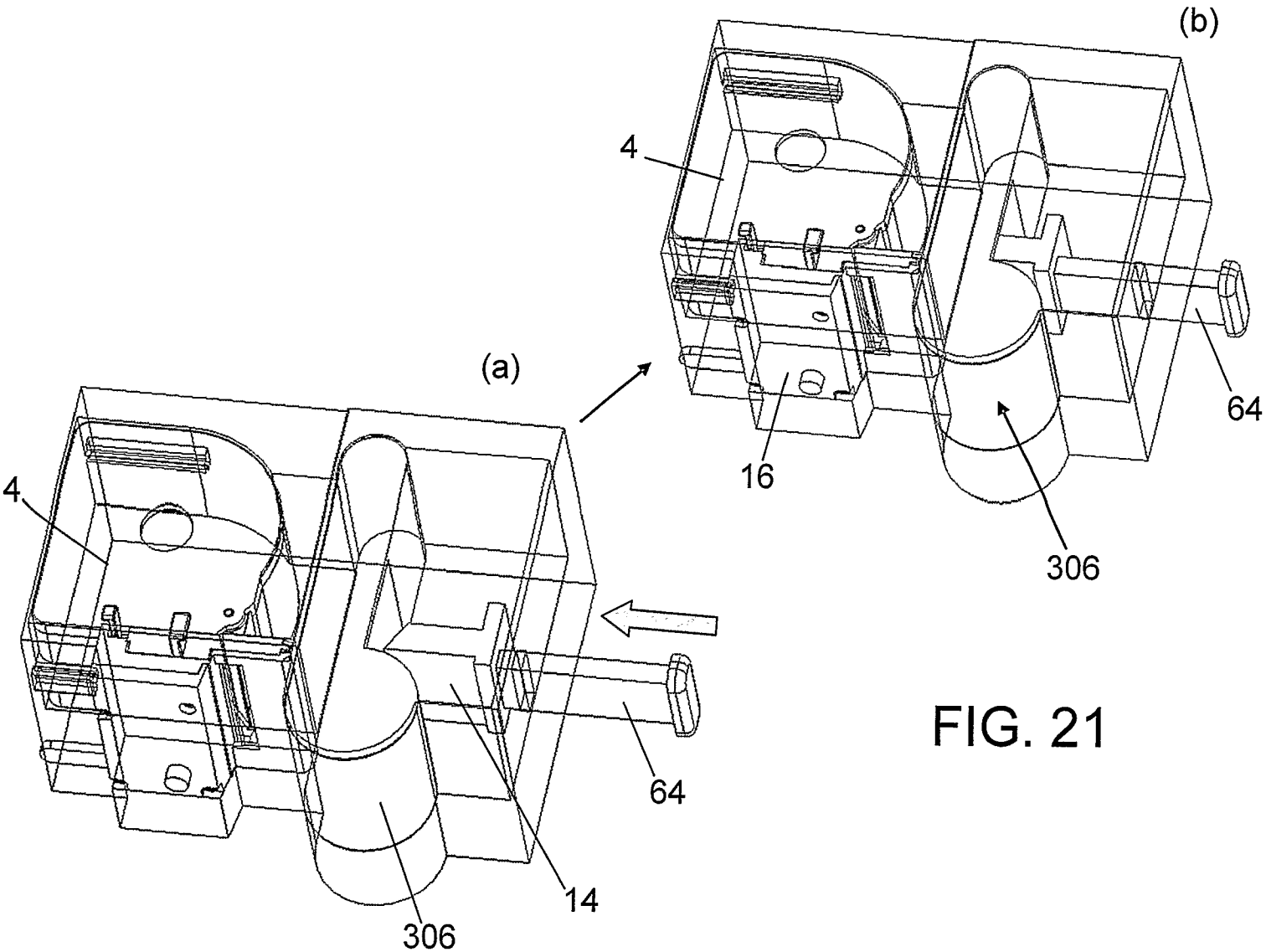
FIG. 21*a* shows a schematic diagram illustrating the movement of the printhead between a nonprinting position and a printing position in the fourth embodiment, the printhead being in the nonprinting position.
FIG. 21*b* shows the printhead in an intermediate position between the nonprinting position and the printing position.
Figure 23:
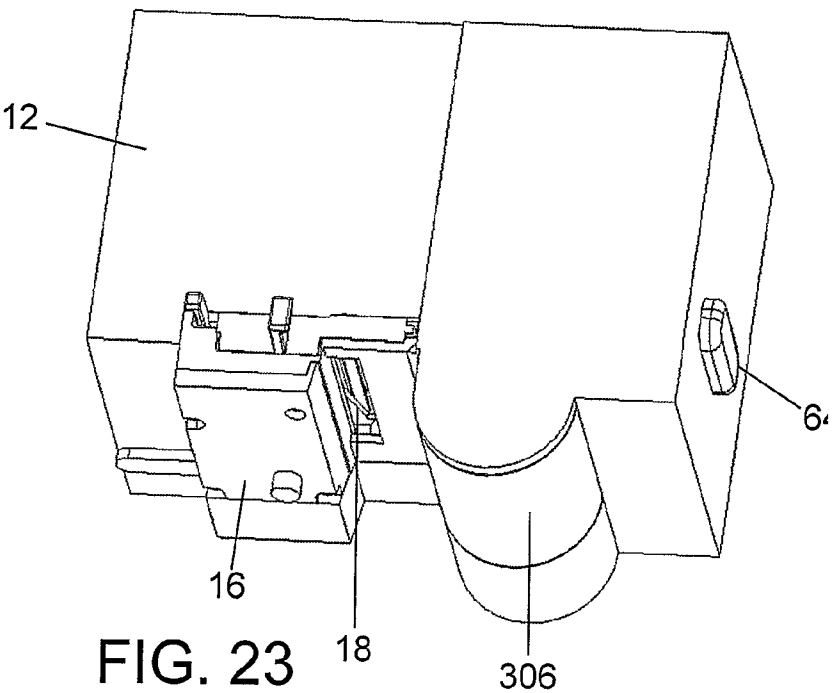
FIG. 23 shows the schematic diagram of FIG. 22 but with the housing not being made transparent.
Figure 22:
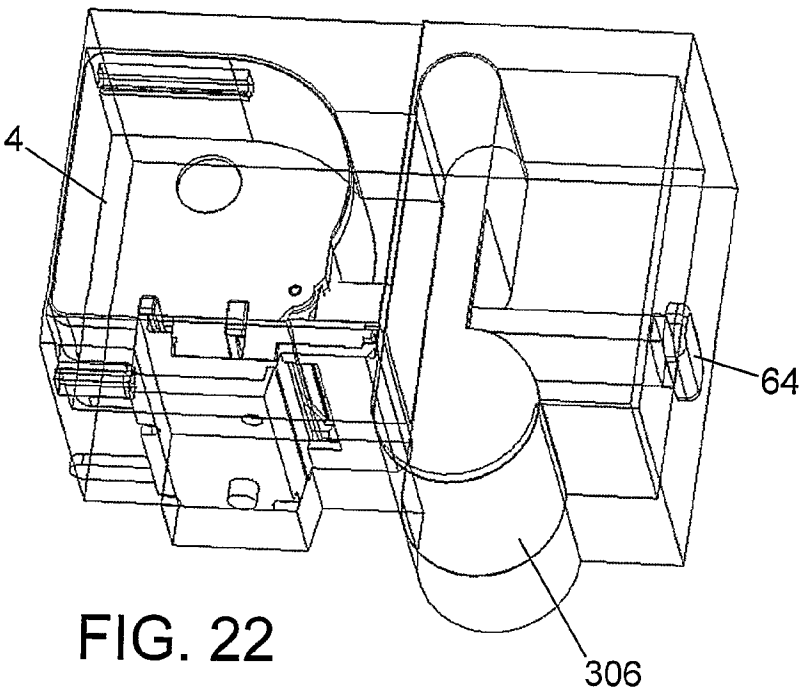
FIG. 22 shows a schematic diagram illustrating the fourth embodiment in its printing arrangement with both the cassettes loaded and the printhead in its printing position, the printer housing being made transparent for clarity.

FIGS. 18 to 23 show in more detail the procedure for inserting the ink ribbon cassette. First, as illustrated in FIGS. 18 and 19, the handle/lever 64 on which the printhead 14 is mounted is moved from its locked position in which the printhead is in its printing position to a position on an opposite side of the ink ribbon cassette receiving portion 304 from said tape cassette receiving portion 8. The ink ribbon cassette 306 can then be inserted into the ink ribbon cassette receiving portion 304. After inserting the ink ribbon cassette 306, the printhead mechanism 64 is actuated by a user whereby the printhead 14 is moved into a printing position and is locked in position by a locking mechanism. In this position, the print head mechanism 64 also holds the ink ribbon cassette in position. The printhead can be locked in position with a push lock system.

The ink ribbon cassette may be similar in structure to that previously described. The cassette 306 illustrated in FIGS. 19 to 23 is of a modified design. However, the cassette still comprises a housing having a two portion structure with an opening therebetween as previously described.

The fourth embodiment has a more simple printhead mechanism than the third embodiment and may therefore be easier and cheaper to manufacture. Furthermore, as there are no tortional forces on the printhead mechanism during use then there is less likelihood of damage to the mechanism over a period of time. However, as the lever 64 in the fourth embodiment extends from the body of the printer in the position illustrated in FIGS. 18 and 19, then the lever may become damaged e.g. if the printer is dropped.

In a fifth embodiment not illustrated, a printer may be provided with a housing comprising a single opening through which both the ink ribbon cassette and the tape cassette may be inserted. In such an arrangement, a fixed printhead may be provided in the printer. An ink ribbon cassette similar to that illustrated in FIG. 2*a* is loaded into the printer first in a lateral direction whereby the printhead in the printer passes through the opening in the cassette and cooperates with the ink ribbon. A tape cassette similar to that previously described is subsequently inserted through the same opening until the platen in the tape cassette cooperates with the printhead with the ink ribbon and tape disposed therebetween. In a modification of this loading procedure, the ink ribbon is partially inserted and then the tape cassette actually pushes the ink ribbon cassette into its printing position when the tape cassette is inserted. In another alternative, the ink ribbon cassette may be attached to the tape cassette prior to insertion of the combined tape and ink ribbon cassettes in a similar manner to that described above.

While this invention has been particularly shown and described with reference to preferred embodiments thereof, it will be understood by those skilled in the art that various changes in form and details may be made therein without departing from the scope of the invention as defined by the appended claims.

The invention claimed is:

1. A tape cassette for a tape printer, the tape cassette comprising a body having a base, a top, and sides extending from the base to the top, the body housing a roll of print receiving medium having an axis of rotation extending in a first direction from the base to the top, the body having a guide member on each of two opposing sides extending along said opposing sides in a second direction perpendicular to the first direction for guiding the tape cassette into a tape printer in the second direction and locating the tape cassette in the tape printer, wherein each guide member extends outwardly from its respective side of the tape cassette and comprises a first elongate member disposed in a plane perpendicular to a plane of its respective side and a second elongate member disposed in a plane parallel to the plane of its respective side, said first elongate member having a first end attached to its respective side and a second end spaced from its respective side, and wherein said second elongate member is attached to said second end of said first elongate member and extends at least partially along a length of said second end, and wherein one of said sides of said cassette other than said opposing sides includes an opening at which said print receiving medium is arranged to pass over a platen of the cassette, each guide member extending from an end of its respective side opposite said side including the opening.

2. A tape cassette according to claim 1, wherein each guide member has a substantially T-shaped cross section.

* * * * *